US012747524B2

(12) United States Patent
Sagara

(10) Patent No.: US 12,747,524 B2
(45) Date of Patent: Sep. 29, 2026

(54) POLYETHYLENE TEREPHTHALATE-BASED HOOK-AND-LOOP FASTENER AND METHOD FOR MANUFACTURING SAME

(71) Applicant: KURARAY FASTENING CO., LTD., Osaka (JP)

(72) Inventor: Makoto Sagara, Sakai (JP)

(73) Assignee: KURARAY FASTENING CO., LTD., Osaka (JP)

( * ) Notice: Subject to any disclaimer, the term of this patent is extended or adjusted under 35 U.S.C. 154(b) by 262 days.

(21) Appl. No.: 18/570,480

(22) PCT Filed: May 9, 2022

(86) PCT No.: PCT/JP2022/019651
§ 371 (c)(1),
(2) Date: Dec. 14, 2023

(87) PCT Pub. No.: WO2022/270159
PCT Pub. Date: Dec. 29, 2022

(65) Prior Publication Data

US 2024/0279850 A1 Aug. 22, 2024

(30) Foreign Application Priority Data

Jun. 22, 2021 (JP) ..... 2021-102909

(51) Int. Cl.
*D03D 15/283* (2021.01)
*A44B 18/00* (2006.01)
(Continued)

(52) U.S. Cl.
CPC ..... *D03D 15/587* (2021.01); *A44B 18/0023* (2013.01); *A44B 18/0046* (2013.01);
(Continued)

(58) Field of Classification Search
CPC .. D03D 15/587; D03D 15/283; D03D 15/292; D03D 27/06; A44B 18/0023; A44B 18/0046; D10B 2401/14; D10B 2501/0632
See application file for complete search history.

(56) References Cited

U.S. PATENT DOCUMENTS

2008/0289157 A1 11/2008 Higashinaka et al.
2014/0230123 A1* 8/2014 Kaikou ..... A44B 18/0073 24/448
2019/0055682 A1 2/2019 Onodera et al.

FOREIGN PATENT DOCUMENTS

CN 102493107 A 6/2012
CN 112647147 A 4/2021
(Continued)

OTHER PUBLICATIONS

[NPL-1] Takayoshi et al. (JP 2015-062600 A); Apr. 9, 2015 (European Patent Office machine translation to English). (Year: 2015).*
(Continued)

*Primary Examiner* — Donald M Flores, Jr.
(74) *Attorney, Agent, or Firm* — Grüneberg Global IP, PLLC

(57) ABSTRACT

A polyethylene terephthalate-based woven hook-and-loop fastener which contains, as a woven base fabric, a fabric having a multifilament yarn made of polyethylene terephthalate as a warp yarn and a polyester-based heat-fusible multifilament yarn as a weft yarn, in which a monofilament yarn made of polyethylene terephthalate is woven in parallel with the warp yarn into the woven base fabric, a hook-shaped engaging element formed from the monofilament yarn and rising from the surface of the woven base fabric exists on the surface of the woven base fabric, and a root of the hook-shaped engaging element is fixed to the woven base fabric by a melt-solidified product of a heat-fusible
(Continued)

component of the heat-fusible multifilament yarn, in which a melting peak temperature of the warp yarn by DSC measurement is in a range of 251.0 to 257.5° C.

17 Claims, 2 Drawing Sheets

(51) Int. Cl.

| | |
|---|---|
| ***D03D 15/292*** | (2021.01) |
| ***D03D 15/54*** | (2021.01) |
| ***D03D 15/567*** | (2021.01) |
| ***D03D 15/587*** | (2021.01) |
| ***D03D 27/06*** | (2006.01) |

(52) U.S. Cl.
CPC ..... *D03D 15/283* (2021.01); *D03D 15/292* (2021.01); *D03D 27/06* (2013.01); *D10B 2401/14* (2013.01); *D10B 2501/0632* (2013.01)

(56) References Cited

FOREIGN PATENT DOCUMENTS

| | | | |
|---|---|---|---|
| JP | 2002233408 A | * | 8/2002 |
| JP | 2007-2240 A | | 1/2007 |
| JP | 2013-244139 | | 12/2013 |
| JP | 2015-62600 | | 4/2015 |
| JP | 2015062600 A | * | 4/2015 |
| JP | 2018-29912 | | 3/2018 |
| JP | 2019-35165 A | | 3/2019 |
| KR | 2001-0083965 A | | 9/2001 |
| WO | 2005/122817 | | 12/2005 |

OTHER PUBLICATIONS

[NPL-1] Masahiko (JP 2002-233408 A); Aug. 20, 2002 (European Patent Office machine translation to English). (Year: 2002).*
Communication pursuant to Rule 164(1) issued in EP Application No. 22828078.0 on Jun. 2, 2025, 11 pages.
Extended European Search Report issued in European Patent Application No. 22828078.0 on Aug. 25, 2025, 10 pages.
International Search Report received for PCT Application No. PCT/JP2022/019651, mailed on Jul. 26, 2022, with English translation, 5 pages.
Written Opinion received for PCT Application No. PCT/JP2022/019651, mailed on Jul. 26, 2022, with English translation, 10 pages.

* cited by examiner

[Fig. 1]
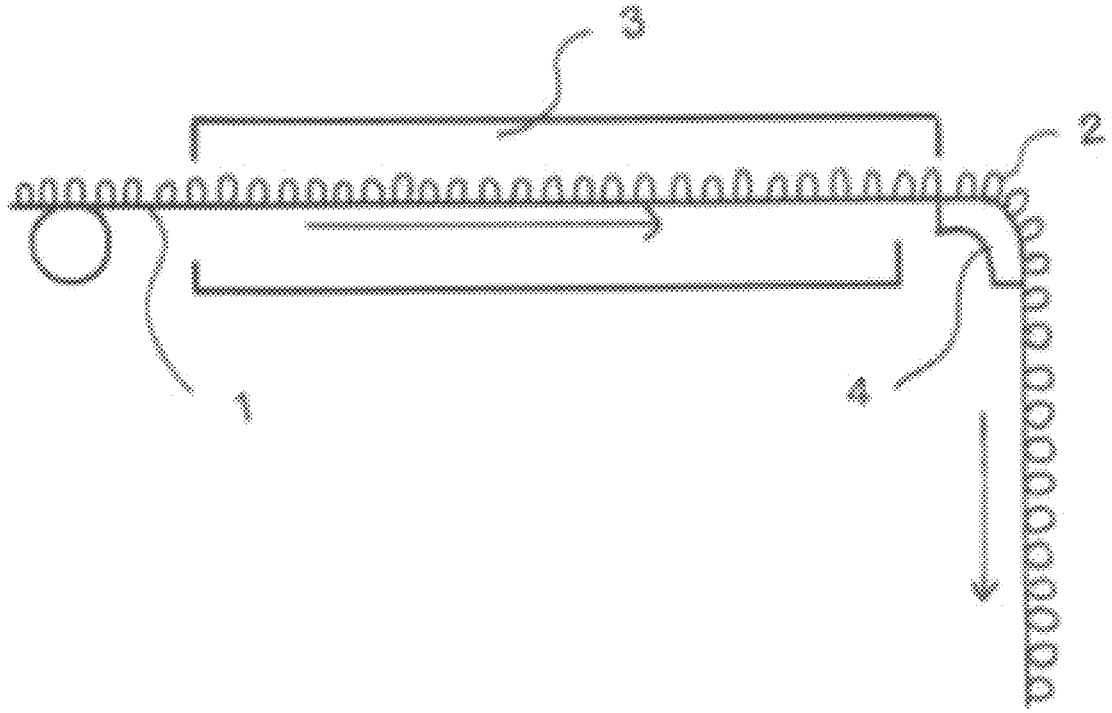
[Fig. 2]
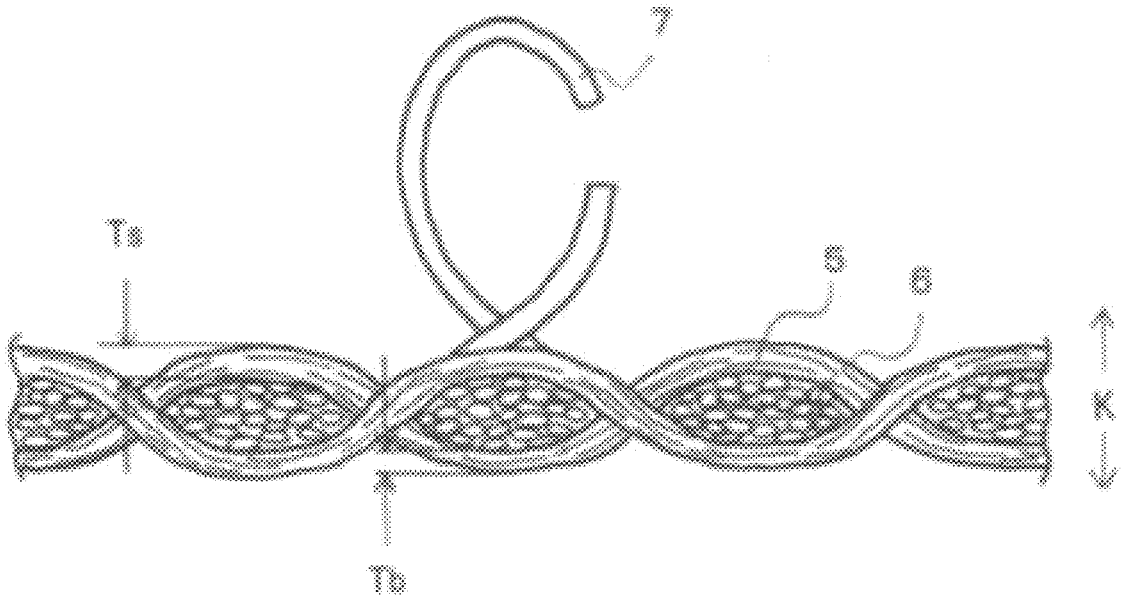

[Fig. 3]
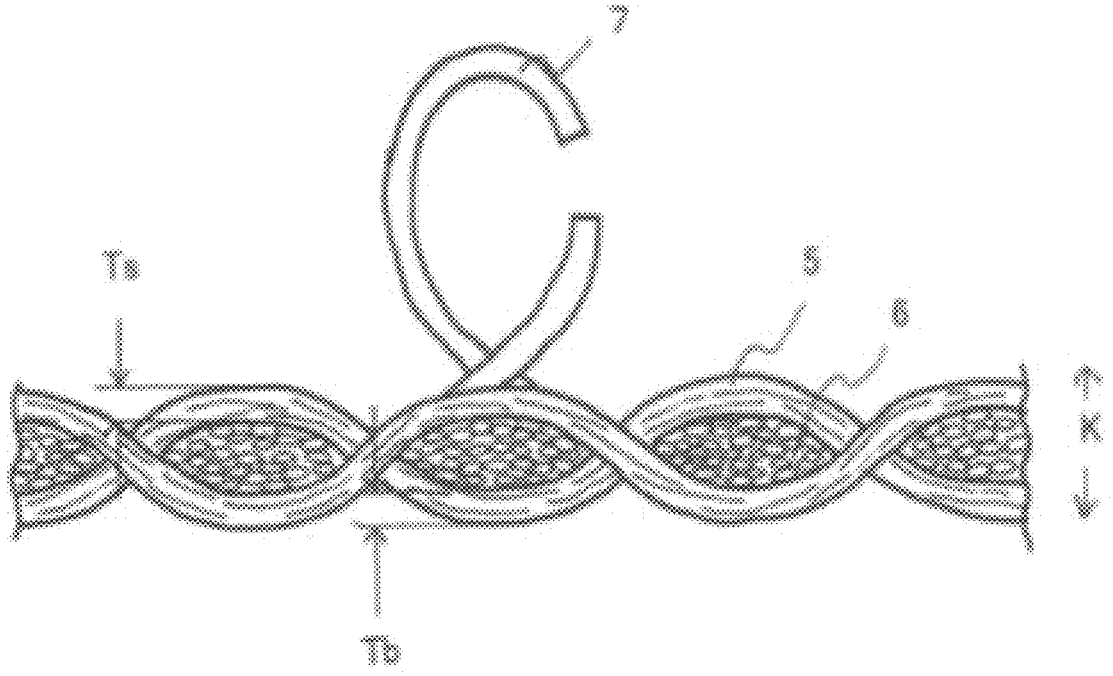

POLYETHYLENE TEREPHTHALATE-BASED HOOK-AND-LOOP FASTENER AND METHOD FOR MANUFACTURING SAME

TECHNICAL FIELD

The present invention relates to a woven fabric-based hook-and-loop fastener (also referred to as a woven hook-and-loop fastener) in which a hook-shaped engaging element and a warp yarn are both made of polyethylene terephthalate (hereinafter abbreviated as PET) yarns, a polyester-based heat-fusible multifilament yarn is used as a weft yarn, and a root of the hook-shaped engaging element is fixed to a woven base fabric of the hook-and-loop fastener by the fusion of the heat-fusible multifilament yarn, in which the hook-shaped engaging element is less likely to be pulled out from the woven base fabric even if the engagement and peeling are repeated, and the woven fabric-based hook-and-loop fastener can be easily dyed in a deep color with a disperse dye, and preferably relates to a woven fabric-based hook-and-loop fastener which satisfies the above-mentioned excellent pull-out resistance and dyeability, and in which yarns constituting the hook-and-loop fastener are less likely to cause uneven heat shrinkage in a heat treatment step for fusing the heat-fusible multifilament yarns, and as a result, the hook-and-loop fastener is less likely to cause waving in the vertical direction, and one leg cut portions of hook-shaped engaging elements are constant due to the less waving, and a method for producing the same.

BACKGROUND ART

Conventionally, as a hook-and-loop fastener having a woven base fabric (also referred to as a woven hook-and-loop fastener), a combination of a so-called woven fabric-based hook type hook-and-loop fastener having a large number of hook-shaped engaging elements made of monofilament yarn on the surface of the woven base fabric and a so-called woven fabric-based loop type hook-and-loop fastener having a large number of loop-shaped engaging elements made of multifilament yarn capable of engaging with the hook-shaped engaging elements on the surface of the woven base fabric has been widely used in application fields such as clothing and daily goods because the engaging elements are less damaged and the engaging force is less reduced even when the engagement and peeling are repeated.

Further, a so-called hook-and-loop-coexisting woven fabric-based hook-and-loop fastener in which a large number of both the hook-shaped engaging elements and the loop-shaped engaging elements are present on the same surface of a woven base fabric is also widely used because the functions of both the hook type hook-and-loop fastener and the loop type hook-and-loop fastener can be provided by one kind of hook-and-loop fastener and hence it is not necessary to use both the hook type hook-and-loop fastener and the loop type hook-and-loop fastener in combination as in the conventional hook-and-loop fastener.

Such a woven fabric-based hook-and-loop fastener is produced by weaving a yarn for engaging elements into the woven base fabric in parallel with the warp yarn so that the yarn for engaging elements protrudes from the surface of the woven base fabric in a loop shape in some places during weaving of the woven base fabric, and after fixing the loop shape by applying heat, when the engaging element is a hook-shaped engaging element, one leg of the loop is cut to make the loop a hook-shaped engaging element, and when the engaging element is a loop-shaped engaging element, one leg is not cut. However, in order to prevent the yarn for engaging elements woven in parallel with the woven base fabric composed of the warp yarn and the weft yarn from being pulled out from the woven base fabric by the tensile force when the engagement is peeled off, a urethane or acrylic resin agent called a back coat adhesive is usually applied to the back surface of the woven base fabric.

However, when the back coat adhesive liquid is applied to the back surface of the woven base fabric and dried, an organic solvent used in the adhesive liquid deteriorates the work environment, and when the organic solvent is recovered, a device for that purpose is required, and further, a process, a device, and time for drying the adhesive liquid are required, and as a result, productivity is reduced, and it is also necessary to periodically remove the adhesive adhered to the device during application and drying, and productivity is also reduced in this respect.

Further, the woven hook-and-loop fastener to which the back coat adhesive liquid is applied has disadvantages that the flexibility of the woven base fabric is lost by an adhesive layer existing on the back surface of the woven base fabric and the woven base fabric is liable to become rigid and therefore, the flexible feeling of the fabric or the like to which the woven hook-and-loop fastener is attached is lowered and the air permeability of the woven hook-and-loop fastener is lowered due to the adhesive layer.

Furthermore, when the back coat adhesive liquid is applied to the back surface of the woven base fabric, if such a woven hook-and-loop fastener is dyed, the dye liquid cannot penetrate the woven base fabric due to the adhesive layer existing on the back surface of the woven base fabric, and thus the woven base fabric cannot be dyed uniformly and darkly. Therefore, it is necessary to dye before applying the back coat adhesive liquid. When dyeing before applying the back coat adhesive liquid, dyeing is performed in a state in which the yarn for engaging elements and the like are not fixed to the woven base fabric. Therefore, during the dyeing process, the yarns constituting the woven base fabric move, such as slipping, and the arrangement of the engaging elements is disturbed, or in the case where the engaging element is a hook-shaped engaging element, when the arrangement of the loops for engaging elements is disturbed, and then one leg of the loop for engaging elements is cut to form a hook-shaped engaging element, it is difficult to reliably cut only one leg, and there are cases in which both legs are cut, cases in which both legs are not cut, and cases in which one leg is only cut to the middle.

In addition, since the woven hook-and-loop fastener must be dyed in the middle of its production, it is necessary to prepare woven hook-and-loop fasteners of many colors in advance in order to promptly meet the color requirements of the user, which naturally results in an increase in the stock quantity and requires personnel and expenses for the storage and management thereof.

As a woven hook-and-loop fastener for solving the problems of the woven hook-and-loop fastener having such a back coat adhesive layer, PTL 1 describes a fabric hook-and-loop fastener composed of a warp yarn, a weft yarn including a heat-fusible multifilament yarn, and a yarn for engaging elements, in which a polyester-based yarn is used as the warp yarn, the weft yarn, and the yarn for engaging elements, and the yarn for engaging elements is fixed to a woven base fabric by fusion of the heat-fusible multifilament yarn used as the weft yarn and heat shrinkage of these yarns.

In addition, PTL 2 also describes a combination of a hook type hook-and-loop fastener in which a large number of hook-shaped engaging elements formed from a yarn for PET hook-shaped engaging elements woven in parallel with the warp yarn rise on one side of a woven base fabric formed from a polyester-based warp yarn and a polyester-based weft yarn, and a root of the hook-shaped engaging element is fixed to the woven base fabric by fusion of a heat-fusible multifilament yarn used as the weft yarn; and a loop type hook-and-loop fastener in which a large number of loop-shaped engaging elements formed from a yarn for polybutylene terephthalate (hereinafter abbreviated as PBT) loop-shaped engaging elements woven in parallel with the warp yarn rise on one side of a woven base fabric formed from a polyester-based warp yarn and a polyester-based weft yarn, and the root of the loop-shaped engaging element is fixed to the woven base fabric by fusion of a heat-fusible multifilament yarn used as the weft yarn.

Certainly, when the method of fixing the root of the engaging element using the heat-fusible multifilament yarn described in these patent documents is used, many of the above-mentioned problems caused by the use of the back coat adhesive liquid can be solved, but the fixing of the root of the engaging element using the heat-fusible multifilament yarn is insufficient. In these patent documents, in order to compensate for the fixing of the root of the engaging element, a method is described in which a yarn that shrinks at a high temperature is used as the warp yarn, the weft yarn, and the yarn for engaging elements constituting the woven hook-and-loop fastener, and the root of the engaging element is tightened to the woven base fabric by the heat shrinkage of the warp yarn, the weft yarn, and the yarn for engaging elements.

However, it has been found that the fixation of the engaging element by fusion using a heat-fusible multifilament yarn and by heat shrinkage of the warp yarn, the weft yarn, and the yarn for engaging elements described in these documents is still insufficient, and that the fixation of the engaging element is released while the engagement and peeling are repeated, and a phenomenon in which the engaging element is pulled out from the surface of the woven hook-and-loop fastener occurs.

Further, it has been found that although such a polyester-based woven hook-and-loop fastener is dyed with a disperse dye, as the engagement and peeling of such a dyed woven hook-and-loop fastener are repeated, the surface of the monofilament yarn is worn or peeled off to expose an inner layer which is hardly dyed, and the presence of a whitish engaging element on the surface of the woven hook-and-loop fastener becomes noticeable.

CITATION LIST

Patent Literature

PTL 1: WO 2005/122817 A
PTL 2: JP 2013-244139 A

SUMMARY OF INVENTION

Technical Problem

It is an object of the present invention to provide a woven fabric-based woven hook-and-loop fastener in which engaging elements are less likely to be pulled out from a woven base fabric even when engagement and peeling are repeated, and which can be easily dyed in a deep color with a disperse dye, by improving the above-mentioned problems of the woven fabric-based woven hook-and-loop fastener obtained by fixing a yarn for hook-shaped engaging elements to a woven base fabric of a woven hook-and-loop fastener by fusing a heat-fusible multifilament yarn used as a weft yarn as described in the above-mentioned patent documents.

Preferably, it is an object of the present invention to provide a PET-based woven hook-and-loop fastener having no back coat adhesive, which is less likely to cause waving in the vertical direction or the like of the woven hook-and-loop fastener due to uneven shrinkage of yarns constituting the woven hook-and-loop fastener in a heat treatment step for fusing the heat-fusible multifilament yarns or a dyeing step of the woven hook-and-loop fastener.

Solution to Problem

That is, the present invention provides a polyethylene terephthalate-based woven hook-and-loop fastener which includes, as a woven base fabric, a fabric having a multifilament yarn made of PET as a warp yarn and a polyester-based heat-fusible multifilament yarn as a weft yarn, in which a monofilament yarn made of PET is woven in parallel with the warp yarn into the woven base fabric, a hook-shaped engaging element formed from the monofilament yarn and rising from the surface of the woven base fabric exists on the surface of the woven base fabric, and a root of the hook-shaped engaging element is fixed to the woven base fabric by a melt-solidified product of a heat-fusible component of the polyester-based heat-fusible multifilament yarn, in which a melting peak temperature of the warp yarn by DSC measurement is in a range of 251.0 to 257.5° C.

In such a PET-based woven hook-and-loop fastener, the molecular weight distribution (Mw/Mn) of the PET constituting the warp yarn preferably satisfies the range of 4.0 to 4.5, and the melting peak temperature of the monofilament yarn by DSC measurement is preferably within the range of 251.0 to 257.5° C., and the molecular weight distribution (Mw/Mn) of the PET constituting the monofilament yarn is preferably within the range of 3.8 to 4.7. In addition, in such a PET-based woven hook-and-loop fastener, preferably, the woven base fabric satisfies the condition that the thickness of the warp yarn in the woven base fabric thickness direction at a position where the warp yarn, which floats and sinks above and below the weft yarn with the weft yarn interposed therebetween, sinks most on the back surface side is 0.94 times or less the thickness of the warp yarn in the woven base fabric thickness direction at a position where the warp yarn floats most on the front surface side.

Further, preferably, in such a PET-based woven hook-and-loop fastener, the degree of exhaustion is within a range of 95 to 97%, and the yarn is made of PET recovered from a polyethylene terephthalate bottle.

Preferably, in such a PET-based woven hook-and-loop fastener, on the surface of the woven base fabric, a loop-shaped engaging element formed from a polyester-based multifilament yarn and rising from the surface of the woven base fabric coexists on the same surface as the hook-shaped engaging element, a root of the loop-shaped engaging element is fixed to the woven base fabric by a melt-solidified product of a heat-fusible component of the heat-fusible multifilament yarn, and the multifilament yarn for loop-shaped engaging elements is a yarn made of PBT.

It is also preferable that the woven hook-and-loop fastener in such a PET-based woven hook-and-loop fastener is dyed with a disperse dye.

Further, the present invention provides a method for producing a polyethylene terephthalate-based woven hook-and-loop fastener in which a multifilament yarn made of PET recovered from a PET bottle is used as a warp yarn, a polyester-based heat-fusible multifilament yarn is used as a weft yarn, and a PET monofilament yarn is woven as a yarn for hook-shaped engaging elements in parallel with the warp yarn, in which hook-shaped engaging elements formed from the yarn for hook-shaped engaging elements are present on the surface of the polyethylene terephthalate-based woven hook-and-loop fastener, and the following Step A, Step B and Step D are performed in this order:

[Step A] a step of, when weaving a woven base fabric having a loop from the warp yarn, the weft yarn, and the yarn for hook-shaped engaging elements, weaving the yarn for hook-shaped engaging elements in parallel with the warp yarn, and at the same time, forming a loop for hook-shaped engaging element by causing the yarn for hook-shaped engaging elements to straddle the warp yarn and to rise in a loop shape from the surface of the woven base fabric at the straddling portion, and weaving the woven base fabric having a loop;

[Step B] a step of guiding the woven base fabric having a loop to a heating region, heating the woven base fabric to a temperature equal to or higher than a temperature at which a heat-fusible component of the heat-fusible multifilament yarn is melted, and fixing the rising portion of the loop for hook-shaped engaging element to the woven base fabric having a loop by a melt from the heat-fusible multifilament yarn; and

[Step D] a step of cutting one leg of the loop for hook-shaped engaging element to form the hook-shaped engaging element.

Preferably, in the method for producing such a PET-based woven hook-and-loop fastener, the yarn for hook-shaped engaging elements is also a yarn made of PET recovered from a PET bottle. Further preferably, in such a method for producing a PET-based woven hook-and-loop fastener, the melting peak temperature by DSC measurement of the warp yarn to be subjected to the Step A is within a range of 251.0 to 257.5° C., and the melting peak temperature by DSC measurement of the yarn for hook-shaped engaging elements to be subjected to the Step A is within a range of 251.0 to 257.5° C.

Further, preferably, in such a method for producing a PET-based woven hook-and-loop fastener, the following Step C is performed between the Step B and the Step D.

[Step C] a step of taking out the woven base fabric having a loop from the heating region of the Step B and pressing the back surface of the woven base fabric having a loop against a fixed surface or a roll surface in a state where the heat-fusible component of the heat-fusible multifilament yarn is melted.

Preferably, the Step C is performed by a method in which the woven base fabric having a loop for hook-shaped engaging element is caused to travel while sliding on the fixed surface while pressing the back surface of the woven base fabric having a loop against the surface, and the traveling direction of the woven base fabric having a loop is changed on the fixed surface, and preferably, the Step C is performed at a temperature lower than the temperature of the Step B by using the residual heat of the Step B without cooling the woven base fabric having a loop for hook-shaped engaging element taken out from the Step B.

Further, preferably, in such a method for producing a PET-based woven hook-and-loop fastener, preferably, the warp yarn and the yarn for hook-shaped engaging elements to be subjected to the Step A satisfy the following conditions (1) to (3):

(1) the warp yarn has a dry heat shrinkage at 200° C. in a range of 20 to 25%;

(2) the yarn for hook-shaped engaging elements has a dry heat shrinkage at 200° C. in a range of 22.5 to 27.5%; and (3) the yarn for hook-shaped engaging elements has a dry heat shrinkage at 200° C. higher than that of the warp yarn at 200° C. by 1 to 5%.

In the method for producing such a PET-based woven hook-and-loop fastener, preferably, in the step A, a multifilament yarn for loop-shaped engaging elements made of polybutylene terephthalate is further woven into the base fabric in parallel with the warp yarn, the multifilament yarn for loop-shaped engaging elements is raised in a loop shape from the surface of the woven base fabric, and the loop for loop-shaped engaging elements is allowed to coexist with the loop for hook-shaped engaging element on the same surface.

Further preferably, in the Step B, the rising portion of the loop for loop-shaped engaging elements is fixed to the woven base fabric having a loop.

Preferably, in the method for producing a PET-based woven hook-and-loop fastener, the obtained PET-based woven hook-and-loop fastener is dyed with a disperse dye.

Advantageous Effects of Invention

In the polyethylene terephthalate-based woven hook-and-loop fastener having hook-shaped engaging elements according to the present invention, the multifilament yarn made of PET (abbreviated as PET multifilament yarn) constituting the warp yarn has a lower melting peak temperature by DSC measurement than the PET multifilament yarn constituting the warp yarn in the conventional woven hook-and-loop fastener, and as a result, the adhesive strength by heat fusion is high.

The PET-based yarn (multifilament yarn and monofilament yarn) constituting the conventional woven hook-and-loop fastener is obtained by melting a PET homopolymer obtained by condensation polymerization of terephthalic acid and ethylene glycol, extruding it from a nozzle, stretching it, and heat-treating it (heat-setting). Such a yarn has an optimum polymerization degree, crystal size, crystallinity, crystal orientation, etc., as a yarn, and has a melting peak temperature in the range of 258 to 263° C. by DSC measurement, except for those used for special applications.

On the other hand, in the present invention, although the PET multifilament yarn constituting the warp yarn is a yarn made of a PET polymer, the melting peak temperature by DSC measurement is lower than that of a yarn made of a PET polymer directly produced from the polymer polymerized for the above yarn. In the present invention, preferably, the PET monofilament yarn constituting the hook-shaped engaging elements also has a melting peak temperature by DSC measurement within the above-mentioned range, and this temperature range is lower than the melting peak temperature of the PET monofilament yarn constituting the yarn for hook-shaped engaging elements in the ordinary woven hook-and-loop fastener, similarly to the multifilament yarn constituting the warp yarn.

By being composed of such a special yarn, it is possible to increase the adhesive force by heat fusion, the root of the hook-shaped engaging element is firmly fixed to the woven base fabric, and it is possible to make it difficult for the hook-shaped engaging elements to be pulled out from the woven base fabric of the woven hook-and-loop fastener even if engagement and peeling are repeated. Further, in the heat fusion treatment step, the yarn can be greatly shrunk, and also in this point, the yarn for engaging elements can be firmly fixed to the woven base fabric by the fusion component. In addition, the inside of the multifilament yarn can be uniformly dyed in a deep color by an ordinary dyeing treatment with a disperse dye. In particular, in the case of a thick monofilament yarn for hook-shaped engaging elements, the effect of being able to dye in a deep color is even greater.

In general, when a yarn having a high heat shrinkage is used, the resulting woven hook-and-loop fastener is likely to cause non-uniform shrinkage of the shrinkable yarn in the heat fusion treatment step, and as a result, the woven hook-and-loop fastener is likely to rise and fall in the vertical direction (so-called waving). The waving of the woven hook-and-loop fastener in the vertical direction caused by the uneven shrinkage is more likely to occur as the heat shrinkage is increased. When the waving occurs, it is difficult to reliably cut only a certain portion of one leg of the loop for hook-shaped engaging element to form a hook-shaped engaging element, and furthermore, in a high-temperature and high-pressure dyeing treatment using an ordinary disperse dye, a problem is likely to occur in that a drift of the dyeing liquid occurs, and it is difficult to obtain a dyed product dyed uniformly in a deep color. However, in the present invention, by performing the above-described Step C immediately after the heat fusion treatment step B, the non-uniform shrinkage can be eliminated, and the problem caused by the above-described non-uniform shrinkage can also be eliminated.

As described above, in the present invention, it is necessary that the PET multifilament yarn constituting the warp yarn has a specific melting peak temperature, and it is preferable that the PET monofilament yarn constituting the yarn for hook-shaped engaging elements also has the above-described specific melting peak temperature. As the PET yarn having such a specific melting peak temperature, a yarn recovered from a PET bottle or the like and produced therefrom (a yarn made of PET recovered from a PET bottle), that is, a recycled PET yarn is particularly suitable.

The recycled PET yarn is obtained by recovering a PET resin or the like used in a PET bottle or the like, re-melting and pelletizing the recovered PET resin or the like, further melting the pellets again, spinning the melted pellets, and stretching and heat-treating the spun pellets. However, such a multifilament yarn or monofilament yarn made of recycled PET often contains a substance that acts as a crystallization inhibitor during the recovery process. Furthermore, PET for bottles (PET used for PET bottles and the like) is produced by solid phase polymerization, and low molecular weight substances are necessarily removed so that low polymers do not dissolve in beverages in bottles, and therefore, multifilament yarns and monofilament yarns made of recycled PET are in a state where low molecular weight substances that lubricate the movement of molecules have been removed, and thus have a structure in which PET molecules do not easily move during crystallization. From these facts, the crystal size of the PET yarn obtained by recycling is smaller than that of a usual PET yarn polymerized for fiber, and as a result, the melting peak temperature by DSC measurement tends to be low. However, there are various types and variations in the composition of the recycled PET depending on recycling raw materials, recovery conditions, recycling conditions, and the like.

Therefore, the effect of the present invention can be obtained by selecting a yarn having a melting peak temperature satisfying the range defined in the present invention by DSC measurement from commercially available recycled PET yarns, more preferably by selecting a yarn having a molecular weight distribution and a heat shrinkage defined in the present invention, and using the selected yarn.

The reason why the yarn having a melting peak temperature by DSC measurement in a specific range as defined in the present invention has a high heat shrinkage, a high heat fusion bonding force, and a high dyeability is not necessarily clear, but as described above, it is presumed that the recycled PET yarn has a considerably small crystal size as compared with a usual PET yarn made of a polymer polymerized for fiber, and the chopped amorphous regions connecting the small-sized crystals have a high heat shrinkage and a high heat fusion property with the heat-fusible polyester polymer constituting the heat-fusible multifilament yarn, and the small-sized crystals are substantially uniformly dispersed in the fiber.

BRIEF DESCRIPTION OF DRAWINGS

FIG. 1 is a view schematically showing an example of a heat treatment apparatus in a heat treatment suitably used in producing the woven hook-and-loop fastener of the present invention.

FIG. 2 is a view schematically showing a cross section of a preferred example of the woven hook-and-loop fastener of the present invention in a plane parallel to the warp yarn of the woven base fabric when the Step C is carried out.

FIG. 3 is a view schematically showing a cross section in a plane parallel to the warp yarn of the woven base fabric of the woven hook-and-loop fastener when the Step C is not carried out.

DESCRIPTION OF EMBODIMENTS

Hereinafter, the present invention will be described in detail. First, the PET-based woven hook-and-loop fastener having the hook-shaped engaging elements of the present invention is roughly classified into two types: a hook type hook-and-loop fastener in which only the hook-shaped engaging elements are present on the front surface of the woven base fabric; and a hook-and-loop-coexisting type hook-and-loop fastener in which the hook-shaped engaging elements and the loop-shaped engaging elements coexist on the front surface of the woven base fabric.

Among them, the hook type hook-and-loop fastener is mainly formed of a monofilament yarn for hook-shaped engaging elements, a multifilament yarn for warp yarns, and a multifilament yarn for weft yarns. In addition, the hook-and-loop-coexisting type hook-and-loop fastener in which hook-shaped engaging elements and loop-shaped engaging elements coexist on the same face is mainly formed of a monofilament yarn for hook-shaped engaging elements, a multifilament yarn for loop-shaped engaging elements, a multifilament yarn for warp yarns, and a multifilament yarn for weft yarns. If necessary, a small amount of yarn other than these yarns may be woven into the woven hook-and-loop fastener.

In the present invention, the warp yarns, the weft yarns, and the yarns for engaging elements are required to be substantially composed of a polyester-based polymer in order to prevent the occurrence of waving due to water absorption or moisture absorption, to form a strong bonding between the yarns by heat fusion, to prevent the yarns from yellowing in the heat fusion step, and, because polyester fibers are used for all of clothes, daily sundries, and the like, to simultaneously dye the attached woven hook-and-loop fastener in the same color when these products are dyed.

Specifically, since the above requirement can be highly achieved, a multifilament yarn made of PET is used for the warp yarn, a monofilament yarn made of PET is used for the yarn for hook-shaped engaging elements, a multifilament yarn made of PBT-based polyester is preferably used for the yarn for loop-shaped engaging elements, and a polyester-based multifilament yarn is also used for the weft yarn.

PET, which is a polymer having an ethylene terephthalate unit as a repeating unit and is obtained by a condensation reaction of terephthalic acid and ethylene glycol, is used for the warp yarn and the yarn for hook-shaped engaging elements. Further, a small amount of other polymers may be added to the PET.

When the melting peak temperature of the PET constituting the warp yarn is measured by DSC, the melting peak temperature needs to be in the range of 251.0 to 257.5° C., and this temperature range is slightly lower than the melting peak temperature of a usual PET for fiber. Furthermore, when the yarn for hook-shaped engaging elements also has a melting peak temperature in this range, the effect of the present invention is further improved, which is preferable.

When the melting peak temperature is higher than the above range, the adhesive force by heat fusion is decreased, and the heat shrinkage in the heat treatment also is decreased, so that the root of the hook-shaped engaging element is hardly firmly fixed to the woven base fabric, the hook-shaped engaging elements are easily pulled out from the woven hook-and-loop fastener woven base fabric by repetition of engagement and peeling, and it is difficult to dye the inside of the multifilament yarn uniformly in a dark color by a usual dyeing treatment with a disperse dye. In particular, in the case of a thick PET monofilament yarn, it is extremely difficult to dye the inside of the filament yarn in a deep color. On the other hand, when the temperature is lower than the above temperature range, the woven base fabric becomes hard in the heat treatment step, and the uprightness of the engaging elements of the obtained woven hook-and-loop fastener and the formation of a uniform loop shape are impaired, and as a result, the engaging force of the woven hook-and-loop fastener is lowered. The melting peak temperature is preferably in the range of 252.0 to 257.0° C., and more preferably 253.0 to 257.0° C.

The melting peak temperature by the DSC measurement specified in the present invention is the peak temperature of the endothermic peak in the vicinity of the melting temperature at first heating in the case where about 6.5 mg of the dried yarn is placed in an aluminum cell, 50 mL/min of nitrogen gas is flowed in a nitrogen atmosphere by a differential calorimeter, and in this state, the temperature is raised from about 30° C. to 300° C. at a temperature raising rate of 50° C./min. The measurement is performed on five yarns arbitrarily taken out, and the average value of three points excluding the minimum value and the maximum value from the obtained five values is obtained.

In the present invention, the PET yarn constituting the warp yarn is characterized in that its melting peak temperature is slightly lower than the melting peak temperature of the usual PET for fiber as described above, but in order to lower the melting peak temperature of the crystalline polymer, a method of copolymerizing a copolymerization component in the polymer to make it difficult to crystallize is generally used. In the present invention, a yarn made of PET having a melting peak temperature slightly lowered by slightly copolymerizing a copolymerization component may be used, but particularly a yarn made of recycled PET having a molecular weight distribution (Mw/Mn) in the range of 4.0 to 4.5 is preferable, and more preferably 4.1 to 4.4, because the features of the present invention are highly achieved. Regarding the monofilament yarn constituting the hook-shaped engaging element, the molecular weight distribution (Mw/Mn) of PET constituting the monofilament yarn is preferably 3.8 to 4.7, and more preferably 3.9 to 4.6.

In addition, the melting peak temperature and the molecular weight distribution are defined as values measured for a yarn taken out from the woven hook-and-loop fastener after the product (after production), but regarding the melting peak temperature, there is almost no difference even if the yarn before the product (before production) is measured, but regarding the molecular weight distribution, the yarn before the product is slightly higher (sharper).

The weft yarn is also required to be a polyester-based yarn, i.e., a polyester-based heat-fusible multifilament yarn, specifically, a multifilament yarn containing a polyester-based resin having a melting point much lower than that of PET constituting the warp yarn and the hook-shaped engaging elements, and as the heat-fusible component constituting the yarn, a PET-based or PBT-based polyester obtained by copolymerizing a large amount of a copolymerization component other than terephthalic acid, ethylene glycol, and butanediol, for example, isophthalic acid or diethylene glycol is suitably used in order to lower the melting point.

Further, the yarn for loop-shaped engaging elements is also preferably a polyester-based yarn, and in particular, a yarn made of a PBT-based polyester is suitably used from the viewpoint of excellent dyeability, flexibility, round loop formability and loop shape retainability, but a yarn made of a PET-based polyester may also be used. When the loop-shaped engaging element made of the PBT-based polyester is present, the melting point of the heat-fusible component of the weft yarn needs to be lower than the melting point of the PBT-based polyester used in the loop-shaped engaging element.

In the present invention, the PET multifilament yarn used as warp yarn (also referred to as PET multifilament yarn for warp yarns) is required to have a melting peak temperature by DSC measurement in the range of 251.0 to 257.5° C. as described above, and preferably the PET multifilament yarn used as warp yarn has a dry heat shrinkage at 200° C. in the range of 20 to 25%, the PET monofilament yarn used as yarn for hook-shaped engaging elements has a dry heat shrinkage at 200° C. in the range of 22.5 to 27.5%, and the dry heat shrinkage at 200° C. of the monofilament yarn for hook-shaped engaging elements is 1 to 5% higher than the dry heat shrinkage at 200° C. of the multifilament yarn for warp yarns.

When the dry heat shrinkage at 200° C. of the PET multifilament yarn for warp yarns is less than 20%, when the dry heat shrinkage at 200° C. of the monofilament yarn for hook-shaped engaging elements is less than 22.5%, or when the dry heat shrinkage at 200° C. of the monofilament yarn for hook-shaped engaging elements is higher than the dry heat shrinkage at 200° C. of the multifilament yarn for warp yarns by less than 1%, the effect of the present invention to improve the pull-out resistance of the engaging elements is somewhat deteriorated.

On the contrary, when the dry heat shrinkage at 200° C. of the PET multifilament yarn for warp yarns exceeds 25%, when the dry heat shrinkage at 200° C. of the monofilament yarn for hook-shaped engaging elements exceeds 27.5%, or when the dry heat shrinkage at 200° C. of the monofilament yarn for hook-shaped engaging elements is higher than the dry heat shrinkage at 200° C. of the multifilament yarn for warp yarns by more than 5%, troubles tend to occur during the production of the woven hook-and-loop fastener.

The dry heat shrinkage at 200° C. specified in the present invention is a mean value of shrinkage ratios calculated from lengths before and after heating by measuring the lengths of yarns after heating after leaving 10 yarns cut in 50 cm in a 200° C. atmosphere for 1 minute in a free state without applying a load.

The melting peak temperature by DSC measurement and the dry heat shrinkage can be easily obtained by requesting a synthetic fiber manufacturer to meet the above numerical values.

Preferably, the dry heat shrinkage at 200° C. of the PET multifilament yarn for warp yarns is in the range of 20.5 to 24.5%, the dry heat shrinkage at 200° C. of the monofilament yarn for hook-shaped engaging elements is in the range of 23 to 26%, and the dry heat shrinkage at 200° C. of the monofilament yarn for hook-shaped engaging elements is 1.5 to 4.5% higher than the dry heat shrinkage at 200° C. of the PET multifilament yarn for warp yarns.

Furthermore, in the present invention, it is preferable that the melting peak temperature of PET constituting the PET multifilament yarn for warp yarns forming the woven hook-and-loop fastener satisfies the above range, and the molecular weight distribution (Mw/Mn) is in the range of 4.0 to 4.5. The range of 4.1 to 4.4 is particularly preferable. Furthermore, with respect to the monofilament yarn constituting the hook-shaped engaging elements, it is preferable that the melting peak temperature of PET constituting the monofilament yarn is in the range of 251.0 to 257.5° C. and the molecular weight distribution (Mw/Mn) of PET constituting the monofilament yarn satisfies the above range of 3.8 to 4.7, since the effect of the present invention becomes more remarkable.

Generally, when a multifilament yarn and a monofilament yarn made of PET polymerized for fibers are used as the warp yarn and the yarn for hook-shaped engaging elements, respectively, the molecular weight distribution (Mw/Mn) of PET of the warp yarn constituting the hook type hook-and-loop fastener is in a range of 4.6 to 5.2, and the molecular weight distribution (Mw/Mn) of PET of the hook-shaped engaging elements is in a range of 4.8 to 5.3. On the other hand, in the present invention, the molecular weight distribution of the PET of the warp yarn constituting the hook type hook-and-loop fastener and the molecular weight distribution of the PET of the hook-shaped engaging elements are preferably smaller than the above-mentioned range, that is, both molecular weight distributions are preferably sharp (narrow), from the viewpoint of providing a fabric-based woven hook-and-loop fastener in which the engaging elements are less likely to be pulled out from the woven base fabric even when engagement and peeling are repeated and which can be easily dyed in a deep color with a disperse dye.

In general, in PET for bottles, low molecular weight substances are removed by solid phase polymerization as described above, and therefore, the influence thereof remains even in the warp yarn made of recycled PET and the yarn for hook-shaped engaging elements made of recycled PET, and the low molecular weight substances are removed and the molecular weight distribution becomes sharp. As a result, in such a yarn made of recycled PET, since the low molecular weight substance which lubricates the movement of molecules is removed. PET molecules do not easily move during crystallization, and as a result, the yarn is in a crystalline state in which a large number of fine crystals are uniformly dispersed, and this is expected to lower the melting peak temperature of the yarn. In addition, since a large number of fine crystals are dispersed, it is expected that the heat shrinkage of the yarn is high, and the disperse dye easily enters between the fine crystals.

The weight-average molecular weight (Mw) of PET constituting the multifilament yarn for warp yarns and the monofilament yarn for hook-shaped engaging elements is preferably in the range of 16000 to 22000. In addition, the Mw/Mn value does not largely change before use in woven hook-and-loop fastener, after use in woven hook-and-loop fastener, and further after dyeing, but the above range means a value after production of woven hook-and-loop fastener and after dyeing treatment. Therefore, it is preferable that the multifilament yarn for warp yarns and the monofilament yarn for hook-shaped engaging elements at the stage of being used as raw materials of the woven hook-and-loop fastener also have the above-mentioned molecular weight distribution.

The molecular weight distribution (Mw/Mn) referred to in the present invention is a value measured by gel permeation chromatography (GPC). In this measurement, polymethyl methacrylate is used as a standard substance, and HFIP (hexafluoroisopropanol) is used as a mobile phase. Specifically, the measurement is performed under the following measurement conditions. In the measurement, five samples taken out arbitrarily are measured, and the average value of three points obtained by excluding the minimum value and the maximum value from the measured values of the five points is used.

Apparatus: liquid chromatography apparatus (HLC-8320) manufactured by Tosoh Corporation
Column: GMHHR-H (S) manufactured by Tosoh Corporation, two columns connected in series
Solvent and mobile phase: 20 mM Na trifluoroacetate/HFIP
Sample preparation: 40° C.×2 hr after standing overnight
Filtration: 0.45 μm PTFF filter (Sartorius)
Column temperature: 40° C.
Flow rate: 0.2 mL/min
Sample concentration: 0.1 wt %
Injection volume: 10 μL
Measurement time: 28 min
Detector: RI (differential refractive index detector)

In the present invention, as the warp yarn, a multifilament yarn made of PET satisfying the melting peak temperature by DSC measurement described above is used, and as the thickness of the multifilament yarn constituting the warp yarn, a multifilament yarn composed of 18 to 40 filaments and having a total dtex of 80 to 240 dtex is preferred, and a multifilament yarn composed of 24 to 36 filaments and having a total dtex of 90 to 200 dtex is particularly preferred.

As the weft yarn, a multifilament yarn is used, and as the thickness of the multifilament yarn constituting the weft yarn, a multifilament yarn composed of 32 to 64 filaments and having a total dtex of 150 to 300 dtex is preferred, and a multifilament yarn composed of 40 to 56 filaments and having a total dtex of 180 to 250 dtex is particularly preferred.

The weft yarn must contain a low-melting polyester, i.e., a heat-fusible component. A typical example of the multifilament yarn containing such a heat-fusible component is a multifilament yarn composed of a core-sheath type heat-fusible filament in which the sheath component is a low-melting polyester (i.e., a heat-fusible component). Since the weft yarn contains the heat-fusible component, the yarn for hook-shaped engaging elements can be fixed to the woven base fabric, and it is not necessary to apply a polyurethane-based or acrylic back coat adhesive to the back surface of the woven base fabric of the woven hook-and-loop fastener in order to prevent the yarns for engaging elements from being pulled out from the woven base fabric as in the conventional woven hook-and-loop fastener.

It is also possible to fix the yarn for engaging elements to the woven base fabric by using a yarn containing a heat-fusible component in the warp yarn instead of the weft yarn, but since the yarn for hook-shaped engaging elements is driven into the woven base fabric in parallel with the warp yarn, the warp yarn has far fewer points of intersection with the yarn for engaging elements than the weft yarn, and therefore, when a heat-fusible yarn is used only for the warp yarn, it is difficult to firmly fix the yarn for hook-shaped engaging elements to the woven base fabric.

Examples of the multifilament yarn composed of the core-sheath type heat-fusible filaments include a multifilament yarn composed of polyester-based filaments having a core-sheath type cross section in which the core component does not melt under heat treatment conditions but the sheath component melts. Specifically, a representative example is a multifilament yarn composed of a core-sheath type polyester filament containing a PET polymer as a core component and a copolymerized PET or a copolymerized PBT as a sheath component obtained by copolymerizing a large amount, for example, 20 to 30 mol %, of a copolymerization component represented by isophthalic acid, adipic acid, or the like to significantly lower the melting point or softening point (in the present invention, when a crystal is not formed by copolymerization or the like and instead a softening point exists, such a softening point is also referred to as a melting point).

Further, recycled PET recovered from PET bottles and clothes may be used as the core component of the heat-fusible multifilament yarn made of such a polyester-based core-sheath type filament, but even if such a yarn is used as a weft yarn, since the dye does not reach the core component in the core-sheath state at the time of dyeing, it is not effective in dyeing a dark color like the warp yarn and the yarn for hook-shaped engaging elements, and the weft yarn is covered by the warp yarn and the yarn for engaging elements constituting the surfaces of the woven base fabric of the woven hook-and-loop fastener and is hardly exposed on the surfaces of the woven base fabric of the woven hook-and-loop fastener, so it does not contribute to dyeing a dark color. Therefore, the core component of the weft yarn may be a multifilament yarn composed of a core-sheath type composite filament in which PET polymerized for the fiber is used as it is as the fiber.

It is preferable that the melting point of the sheath component of the multifilament yarn composed of the core-sheath type polyester-based heat-fusible filament is in the range of 130 to 210° C., the softening point thereof is in the range of 150 to 230° C., and the melting point is preferably 20 to 150° C. lower than the melting point of the warp yarn, the core component, the monofilament yarn for hook-shaped engaging elements, or the multifilament yarn for loop-shaped engaging elements. The cross-sectional shape of the core-sheath type heat-fusible filament may be a concentric core-sheath shape or an eccentric core-sheath shape, or a single-core core-sheath shape or a multi-core core-sheath shape. A multifilament yarn made of a single-core core-sheath composite filament is preferable.

Furthermore, the ratio of the polyester-based core-sheath type heat-fusible filaments to the weft yarns is particularly preferable in the case where all of the weft yarns are substantially formed of core-sheath type polyester-based heat-fusible filaments, that is, in the case where the weft yarns are multifilament yarns consisting of only core-sheath type polyester-based heat-fusible filaments, since both the yarn for hook-shaped engaging elements and the yarn for loop-shaped engaging elements are firmly fixed to the woven base fabric.

In the case where the filament constituting the weft yarn does not have a core-sheath cross-sectional shape and the entire fiber cross-section is formed of a heat-fusible polymer, the heat-fusible polymer melted and solidified again is fragile and easily broken, and in the case of sewing or the like, the woven base fabric is easily tom from the sewing thread portion. Therefore, the heat-fusible filament preferably contains a resin that is not heat-fused, and particularly preferably has a cross-sectional shape because the effect of fusing adjacent yarns is enhanced. The weight ratio of the core component to the sheath component is preferably in the range of 85:15 to 40:60, and particularly preferably in the range of 80:20 to 60:40.

Further, in order to firmly fix both the yarn for hook-shaped engaging elements and the yarn for loop-shaped engaging elements to the woven base fabric, it is preferable that the heat-fusible component used as the weft yarn is heat-fused and the heat-fusible multifilament yarn itself is shrunk to tighten the root of the hook-shaped engaging element and the loop-shaped engaging element from both sides, and for this purpose, it is also preferable that the polyester-based heat-fusible multifilament yarn used as the weft yarn is heat-shrunk to a certain extent under heat treatment conditions. In particular, a yarn having a dry heat shrinkage at 200° C. of 14 to 20% is suitably used, and particularly a yarn having the dry heat shrinkage of 15 to 19% and a dry heat shrinkage lower by 5 to 12% than the dry heat shrinkage at 200° C. of the warp yarn or the yarn for hook-shaped engaging elements is suitable for enhancing the pull-out resistance of the engaging elements and more highly preventing uneven shrinkage in the widthwise direction of the woven hook-and-loop fastener.

The hook-shaped engaging element is required to have so-called hook shape retention and rigidity in which the hook shape is not extended by a light force, and therefore, a thick monofilament yarn is preferably used. In the present invention, as the monofilament yarn, a monofilament yarn formed from a PET polymer excellent in hook shape retention, which does not melt at a temperature at which the heat-fusible component of the heat-fusible multifilament yarn is heat-fused, and which has the above-described melting peak temperature by DSC measurement is preferably used, and a monofilament yarn having the above-described melting peak temperature, the above-described molecular weight distribution, and the above-described dry heat shrinkage is more preferably used.

The thickness of the monofilament yarn for hook-shaped engaging elements made of such PET is preferably 0.15 to 0.22 mm in diameter from the viewpoint of the engaging force, and more preferably 0.16 to 0.20 mm in diameter. In order to increase the engaging force, the cross-sectional shape of the monofilament may be a modified cross-sectional shape represented by a polygonal shape such as a triangular shape or a quadrangular shape.

The PET-based woven hook-and-loop fastener of the present invention may be a hook-and-loop-coexisting type hook-and-loop fastener on which hook-shaped engaging elements and loop-shaped engaging elements coexist on the front surface as described above, and in the case of such a woven hook-and-loop fastener having loop-shaped engaging elements, the yarn for loop-shaped engaging elements used is preferably composed of a PET-based or PBT-based polyester, and a multifilament yarn composed of a polyester which does not melt at the temperature at which the heat-fusible component of the heat-fusible multifilament yarn is heat-fused, particularly a multifilament yarn made of a PBT-based polyester is preferred from the viewpoint of the touch feeling of the woven hook-and-loop fastener and the spread and resistance to falling of the loop-shaped engaging elements, and because it can be dyed in a deep color under milder dyeing conditions.

When a multifilament yarn made of PET is used as the yarn for loop-shaped engaging elements, it is preferable to use, as such a multifilament yarn, a multifilament yarn made of PET recovered from a PET bottle, that is, recycled PET, which satisfies both the melting peak temperature and the molecular weight distribution described above.

When a multifilament yarn made of PBT is used as the yarn for loop-shaped engaging elements, it is preferable to use a multifilament yarn made of PBT containing 1 to 8% by weight of polytrimethylene terephthalate. In such a multifilament yarn, the filaments constituting the loop-shaped engaging element are easily loosened, and the filaments constituting the multifilament yarn are hardly cut by a loosening treatment using a card clothing or the like, and are hardly cut even when engagement and peeling are repeated, and as a result, engagement strength is improved. In addition, further deep-color dyeing can be performed under mild dyeing conditions with a disperse dye.

As the thickness of the multifilament yarn constituting the yarn for loop-shaped engaging elements, a multifilament yarn composed of 6 to 12 filaments and having a total dtex of 250 to 380 dtex is preferred, and a multifilament yarn composed of 7 to 10 filaments and having a total dtex of 280 to 350 dtex is particularly preferred. As such a multifilament yarn for loop-shaped engaging elements, a multifilament yarn that undergoes heat shrinkage under conditions for fusing the heat-fusible component of the heat-fusible multifilament yarn of the weft yarn is preferred from the viewpoint of the effect of fixing the engaging elements, similarly to the warp yarn. To be specific, a multifilament yarn having a dry heat shrinkage at 200° C. of 12 to 20% is preferred.

The method for producing a polyethylene terephthalate-based woven hook-and-loop fastener of the present invention is the method for producing a woven hook-and-loop fastener described above, and is a method for producing a polyethylene terephthalate-based woven hook-and-loop fastener in which a multifilament yarn made of polyethylene terephthalate recovered from a polyethylene terephthalate bottle is used as a warp yarn, a polyester-based heat-fusible multifilament yarn is used as a weft yarn, and a monofilament yarn made of polyethylene terephthalate is woven as a yarn for hook-shaped engaging elements in parallel with the warp yarn, characterized in that a hook-shaped engaging element, which is formed from the yarn for hook-shaped engaging elements and has a loop with one leg cut off, is present on the surface of the polyethylene terephthalate-based woven hook-and-loop fastener, and the following Step A, Step B, and Step D are performed in this order:

[Step A] a step of, when weaving a woven base fabric having a loop from the warp yarn, the weft yarn, and the yarn for hook-shaped engaging elements, weaving the yarn for hook-shaped engaging elements in parallel with the warp yarn, and at the same time, causing the yarn for hook-shaped engaging elements to straddle the warp yarn and to rise in a loop shape from the surface of the woven base fabric at the straddling portion, and weaving the woven base fabric having a loop;

[Step B] a step of guiding the woven base fabric having a loop to a heating region, heating the woven base fabric to a temperature equal to or higher than a temperature at which a heat-fusible component of the heat-fusible multifilament yarn is melted, and fixing the rising portion of the loop to the woven base fabric having a loop by a melt from the heat-fusible multifilament yarn; and

[Step D] a step of cutting one leg of the loop to form the hook-shaped engaging element.

Further, in the step A, a multifilament yarn for loop-shaped engaging elements made of polybutylene terephthalate may be further woven into a base fabric in parallel with the warp yarn, the multifilament yarn for loop-shaped engaging elements may be raised in a loop shape from the surface of the woven base fabric, and the loop for loop-shaped engaging elements may be allowed to coexist with the loop for hook-shaped engaging element on the same surface. In this case, in the Step B, the rising portion of the loop for loop-shaped engaging elements may be fixed to the woven base fabric having a loop.

First, to explain the above Step A, as the weaving structure of the fabric, a plain weave in which a monofilament yarn for hook-shaped engaging elements and a multifilament yarn for loop-shaped engaging elements are used as part of the warp yarns is preferable, and these yarns for engaging elements are woven in parallel with the warp yarns, rise from the woven base fabric surface in the middle of the structure, and in the case of hook-shaped engaging elements, have a weaving structure that forms a loop, while jumps over one to three warp yarns, and slides in between the warp yarns, while in the case of loop-shaped engaging elements, a weaving structure that forms a loop without straddling the warp yarns or straddling one warp yarn and exists in parallel with the warp yarns is preferable because it can efficiently cut one leg side of the loop for hook-shaped engaging element and the hook-shaped engaging element and the loop-shaped engaging element can be easily engaged.

The weaving density of the warp yarns is preferably 35 to 80 yarns/cm after the heat treatment, and the weaving density of the weft yarns is preferably 12 to 30 yarns/cm after the heat treatment. The weight ratio of the weft yarns is preferably 15 to 40% with respect to the total weight of the yarns for hook-shaped engaging elements, the yarns for loop-shaped engaging elements, the warp yarns, and the weft yarns that constitute the woven hook-and-loop fastener.

In the woven hook-and-loop fastener of the present invention, the height of the hook-shaped engaging elements after heat shrinkage is preferably 1.2 to 1.8 mm from the surface of the woven base fabric, and the height of the loop-shaped engaging elements is preferably 1.9 to 3.0 mm from the surface of the woven base fabric, from the viewpoint of the engaging force and further from the viewpoint of the difficulty in falling of the engaging elements.

In addition, the density of the hook-shaped engaging elements in the hook type hook-and-loop fastener and the total density of the hook-shaped engaging elements and the loop-shaped engaging elements in the hook-and-loop-coexisting type hook-and-loop fastener are preferably 30 to 70 pieces/$cm^2$ and 30 to 70 pieces/$cm^2$, respectively, based on the woven base fabric portion in which the engaging elements are present and based on the width after heat shrinkage. Further, the ratio of the numbers of the hook-shaped engaging elements and the loop-shaped engaging elements in the hook-and-loop-coexisting type hook-and-loop fastener is preferably 40:60 to 60:40.

The number of monofilament yarns for hook-shaped engaging elements to be driven is preferably about 2 to 8 per 20 warp yarns (including the monofilament yarns for hook-shaped engaging elements). In the case of a hook-and-loop-coexisting type hook-and-loop fastener, the total number of monofilament yarns for hook-shaped engaging elements and multifilament yarns for loop-shaped engaging elements is preferably 2 to 8 per 20 warp yarns (including the monofilament yarns for hook-shaped engaging elements and the multifilament yarns for loop-shaped engaging elements), and the number ratio of the monofilament yarns for hook-shaped engaging elements and the multifilament yarns for loop-shaped engaging elements is preferably in the range of 40:60 to 60:40.

When the loops for hook-shaped engaging elements are formed, in order to facilitate the formation of the loops for hook-shaped engaging elements having a uniform height, a method may be used in which a plurality of metal rods are arranged on the woven base fabric in parallel with the warp yarns at positions where the yarns for hook-shaped engaging elements straddle the warp yarns, the yarns for engaging elements are passed over the metal rods to form loops, and the metal rods are pulled out from the loops after the loops are formed.

The woven hook-and-loop fastener fabric (also referred to as a woven base fabric having a loop) thus obtained is then sent to the Step B and subjected to a heat treatment for melting the heat-fusible component as the sheath component of the core-sheath type polyester-based multifilament yarn. Preferably, as shown in FIG. 1, the woven fabric is heat-treated by continuously traveling the woven fabric in a long state in a heat treatment oven (3) without winding the woven fabric on the way. By this heat treatment, the sheath component of the core-sheath type heat-fusible multifilament yarn constituting the weft yarn is melted, and at the same time, the warp yarn, the yarn for engaging elements, and the weft yarn are shrunk to fix the monofilament yarn or the multifilament yarn for engaging elements to the woven base fabric. It is preferable that the long woven hook-and-loop fastener fabric traveling in the heat treatment oven is made to travel without being tensioned so much so as to be sufficiently shrunk.

This eliminates the need for the application and drying treatment of a back coat adhesive, which have been performed in a conventional woven hook-and-loop fastener, and can prevent the occurrence of the above-described problems in the process due to the back coat adhesive and the problem in the woven hook-and-loop fastener that the flexibility of the capability is impaired. Further, the loop shape of the hook-shaped engaging element is fixed by the heat at the time of this heat treatment, and even after one leg of the loop for hook-shaped engaging element is cut off to obtain the hook-shaped engaging element in the subsequent Step D, the hook shape is maintained and sufficient engaging strength can be obtained. Further, in the case of the loop-shaped engaging element, the loop shape becomes a natural and unified shape.

As the temperature during the heat treatment, 150 to 220° C., which is a temperature at which the heat-fusible component constituting the weft yarn is melted or softened but other components or yarns are not melted, and at which the shape of the monofilament yarn for hook-shaped engaging elements is fixed in a loop shape, is generally used, and is more preferably in the range of 185 to 215° C., and still more preferably in the range of 190 to 210° C. Such heat treatment is usually carried out by traveling the woven hook-and-loop fastener fabric in a heated oven. Specifically, the heat treatment is completed by traveling at a speed of 0.30 to 1.30 m/min so as to stay for 20 to 120 seconds in the heating oven.

Next, one leg side portion of the leg portion of the loop for hook-shaped engaging element projecting from the surface of the woven hook-and-loop fastener fabric is cut to form a hook-shaped engaging element (Step D), and the following Step C is preferably performed prior to the Step D, since it is possible to reduce the occurrence of waving in the vertical direction, or the like of the woven hook-and-loop fastener and further prevent the engaging element from being pulled out from the woven base fabric by the repetition of the engagement and peeling.

[Step C] a step of taking out the woven base fabric having a loop from the heating region of the Step B and pressing the back surface of the woven base fabric having a loop against a fixed surface or a roll surface in a state where the heat-fusible component of the heat-fusible multifilament yarn is melted.

That is, by this step C, the yarns constituting the woven base fabric are pressure-bonded to each other, and the heat-fusible component extruded by the pressure-bonding penetrate into the adjacent yarns to further increase the bonding strength, whereby the engaging elements are firmly fixed to the woven base fabric, whereby the engaging elements can be highly prevented from being pulled out from the woven base fabric, and the waving in the vertical direction caused by the shrinkage in the heat treatment step can be eliminated.

In particular, as shown in FIG. 1, it is preferable that the Step C is performed when the woven hook-and-loop fastener fabric (woven base fabric having a loop) subjected to the heat treatment in the Step B has left the heat treatment oven (3), and therefore, an operation of pressing the back surface of the woven base fabric (1) against a fixed surface or a roll surface (4) is carried out when the fabric has left the heat treatment oven (3) in a state in which the heat-fusible component constituting the weft yarn is kept molten. FIG. 1 shows a case in which the back surface of the woven hook-and-loop fastener fabric (1) is pressed against the fixed surface (4) immediately after leaving the heat treatment oven (3).

In particular, in the present invention, when the Step C is carried out by a method in which the woven base fabric having a loop is slid on a fixed surface or a roll surface while being pressed against the fixed surface or the roll surface, the above-mentioned effects of eliminating the waving and improving the pull-out resistance of the engaging elements can be further exhibited. That is, it is particularly preferable to satisfy all of pressing the back surface of the woven base fabric having a loop against a fixed surface or a roll surface, preventing the loops for engaging elements existing on the surface opposite to the surface to be pressed from being pushed down by the operation, and sliding the traveling woven base fabric having a loop on the fixed surface or the roll surface rotating at a surface speed different from the traveling speed of the woven base fabric having a loop.

In this way, the filaments constituting the warp yarns are promoted to move to stable positions by sliding and traveling on the fixed surface or the roll surface while being pressed against the same surface, and accordingly, the weft yarns are also settled in a natural state and the shrunk state is uniformized, and as a result, the distortion of the woven base fabric is eliminated and the squeezing of the heat-fusible component from the weft yarns is promoted.

Then, by pressing the back surface of the woven base fabric against such a fixed surface or a roll surface, the thickness in the woven base fabric thickness direction of the warp yarn, which will be described later and which is floating and sinking above and below the weft yarn with the weft yarn interposed therebetween, at the position where the warp yarn sinks most on the back surface side satisfy 0.94 times or less of the thickness at the position where the warp yarn floats most on the front surface side.

Furthermore, when this Step C is performed, as will be described later, a tensile force applied to the woven base fabric having a loop is preferably set to about 50 to 600 g/cm while changing the traveling direction of the loop woven fabric after the contact with the fixed surface or the roll surface. More preferably, the tensile force of about 100 to 400 g/cm is applied.

It is particularly preferable that the Step C is performed by a method in which the woven base fabric having a loop is caused to travel while sliding on the fixed surface while pressing the back surface of the woven base fabric having a loop against the fixed surface, and the traveling direction of the woven base fabric having a loop is changed on the fixed surface, and by changing the traveling direction, pressing against the fixed surface or the roll surface becomes easy, and the effect of pressing and sliding is improved. In FIG. 1, the woven hook-and-loop fastener fabric (1) changes its traveling direction by 90° along the fixed surface (4).

Further, the Step C is preferably performed at a temperature lower than the temperature of the Step B by utilizing the residual heat of the Step B at the time when the woven base fabric having a loop is still kept in a high temperature state by the heat applied in the Step B without cooling the woven base fabric having a loop taken out from the Step B. Even when the woven base fabric leaving the Step B is cooled and then reheated, the distortion of the woven base fabric having a loop is hardly eliminated, and the effect of the present invention is hardly sufficiently obtained. Therefore, the Step C is preferably performed immediately in the vicinity of the place where the Step B has been performed, while the woven hook-and-loop fastener fabric leaving the Step B is still hot because of the heat applied, i.e. at a temperature lower than that of the Step B.

It is preferable that the front and back surfaces of the woven hook-and-loop fastener fabric are not in contact with any solid object such as a roller or a guide until the back surface is pressed against the fixed surface or the roll surface (4) after entering the heat treatment oven (3), and the fixed surface or the roll surface is the first contact object.

In the present invention, the fixed surface or the roll surface (4) used in the Step C is preferably a surface having a contact length of 20 to 100 mm and a contact time of 2 to 10 seconds with the back surface of the woven base fabric having a loop. Specific examples of the surface include fixed surfaces and roll surfaces made of metals, ceramics, and heat-resistant resins as suitable materials. The surface of the fixed surface or the roll surface may be mirror-finished, satin-finished, or slightly uneven as long as it can press the back surface of the woven base fabric having a loop. The difference in traveling speed when the loop fabric is slid on the fixed surface or the roll surface (in the case of the fixed surface, the speed at which the loop fabric travels thereon, and in the case of the roll surface, the difference between the traveling speed of the loop fabric traveling on the roll surface and the speed of the roll surface) is preferably 4 to 30 mm/sec.

Such fixed surfaces and roll surfaces are preferably heated to a temperature lower than the heat treatment temperature by 80 to 100° C. in order to enhance the contact effect. In general, however, the fixed surfaces and the roll surfaces may be heated by residual heat of the heat-treated woven base fabric having a loop leaving the heat treatment oven. As a result, the temperature of the Step C is naturally lower than the heat treatment temperature of the Step B. When the temperature of the Step C is higher than the temperature of the Step B, the waving in the vertical direction generated in the Step B is eliminated, but the waving may be newly generated by the Step C.

The surface on which the back surface of the woven base fabric having a loop is pressed may be a surface on which the surface is fixed, a roll surface on which the contact surface rotates at a surface speed different from the speed of the woven base fabric according to the traveling of the woven base fabric having a loop, or a roll surface on which a driven roll surface that actively pulls the woven base fabric having a loop rotates at a surface speed different from the speed of the woven base fabric having a loop. In the case of the roll surface, as described above, since it is preferable to have a difference between the surface speed of the roll and the traveling speed of the woven base fabric having a loop which travels by being pressed against the surface of the roll and to slide the back surface of the woven base fabric having a loop over the roll surface, the apparatus becomes complicated, and in the present invention, it is preferable to use a fixed surface as shown in FIG. 1 which is structurally simple and is easy to reliably obtain the effect. The fixed surface may be a guide-like narrow surface, but is preferably a fixed surface having a contact length as described above.

In the present invention, as shown in FIG. 1, it is preferable that the woven base fabric (1) having a loop is made to travel and pass through the heat treatment oven (3), the warp yarn and the weft yarn are shrunk by the heat treatment oven (3) as described above, and then leave the heat treatment oven (3), and are continuously made to travel on the fixed surface or the roll surface (4). Therefore, when the woven base fabric (1) having a loop is pressure-bonded to the fixed surface or the roll surface (4), the woven base fabric (1) having a loop is in a state in which a tensile force is applied in the warp direction. Preferably, a tensile force of about 50 to 600 g/cm is applied to the woven base fabric having a loop immediately after the woven base fabric having a loop passes through the fixed surface or the roll surface (4). More preferably, a tensile force of about 100 to 400 g/cm is applied.

In the case of the woven-fabric based hook-and-loop fastener (woven hook-and-loop fastener) of the present invention, the warp yarns float and sink above and below the weft yarns with the weft yarns interposed therebetween, and therefore, the back surface of the woven base fabric is in a state of being covered with the warp yarns, and the weft yarns in which the heat-fusible component is present hardly come into direct contact with the fixed surface or the roll surface. Therefore, the melt of the heat-fusible component does not directly adhere to the surface of the fixed surface or the roll surface to cause a trouble.

The operation of pressing the back surface of the woven hook-and-loop fastener fabric (1) against the fixed surface or the roll surface (4) in a state in which the heat-fusion component constituting the weft yarn is melted is preferably performed by utilizing the residual heat at the time of heat treatment so as to continue the heat treatment in the heat treatment oven (3) as shown in FIG. 1 without temporarily cooling the heat-treated hook-and-loop fastener fabric from the viewpoint of productivity and further from the viewpoint that the effect of performing the Step C can be highly expressed.

In the method of the present invention, by carrying out the operation step (C) of pressing the back surface of the woven base fabric (1) having a loop against the fixed surface or the roll surface (4) in a state in which the heat-fusible component is melted, as shown in FIG. 2, it is preferable that the thickness (Tb) in the woven base fabric thickness direction of the warp yarn which is floating and sinking above and below the weft yarn with the weft yarn interposed therebetween, at the position where the warp yarn sinks most on the back surface side satisfy 0.94 times or less of the thickness of the warp yarn (Ts) in the woven base fabric thickness direction at the position where the warp yarn floats most on the front surface side.

In particular, in the present invention, in addition to simply pressing against and sliding on a fixed surface, as described above, by sliding on the fixed surface while pressing against the same surface and traveling on the same surface, and changing the traveling direction, the thickness in the woven base fabric thickness direction of the warp yarn which is floating and sinking above and below the weft yarn with the weft yarn interposed therebetween, at the position where the warp yarn sinks most on the back surface side can satisfy 0.90 times or less of the thickness at the position where the warp yarn floats most on the front surface side, which is particularly preferable. In FIG. 2 and FIG. 3, K indicates the woven base fabric thickness direction.

However, when (Tb) is too low, the back surface of the woven hook-and-loop fastener woven base fabric is densified and flattened by heat fusion, and flexibility and texture which are merits of a woven fabric, and air permeability and liquid permeability are impaired, which is not preferable. Therefore, (Tb) is preferably 0.7 times or more, particularly preferably 0.75 times or more, of (Ts).

FIG. 2 schematically shows a cross-sectional state of the woven hook-and-loop fastener in which the effect of the present invention can be further obtained by performing the operation of pressing the back surface of the woven base fabric (1) having a loop against the fixed surface or the roll surface (4) in a state where the heat-fusible component is melted, that is, a case where (Tb) is 0.94 times or less of (Ts). On the other hand, FIG. 3 is a view schematically showing a cross-sectional state of the woven hook-and-loop fastener in the case where the operation of pressing the back surface of the woven base fabric (1) having a loop against the fixed surface or the roll surface (4) in a state where the heat-fusible component is melted is not performed, and in this case, (Tb) has substantially the same value as (Ts), and the ratio of (Tb)/(Ts) does not satisfy 0.94 or less.

Even when the operation of pressing the back surface of the woven base fabric having a loop against the fixed surface or the roll surface in a state where the heat-fusible component is melted, i.e., the Step C, is not performed, the phenomenon that the value of (Tb) is slightly smaller than the value of (Ts) due to the natural gravity on the woven hook-and-loop fastener during the production process of the woven hook-and-loop fastener may occur, but the decrease is extremely slight, and (Tb) does not fall below 0.96 times (Ts).

Next, a method for measuring (Tb) and (Ts) of the warp yarns which are floating and sinking above and below the weft yarns with the weft yarns interposed therebetween will be described.

First, a region on which the engaging elements are present and which is less affected by the engaging elements is selected, and the woven hook-and-loop fastener is cut parallel to the warp yarns so as to cut the central portion of the bulge of the warp yarns using a safety razor blade for shaving as a cutter.

The resulting cross section is then photographed at 200× magnification. As a result, a photograph of the obtained cut portion is schematically shown in FIG. 2. From this photograph, three points at which the warp yarns sink most on the back surface side are arbitrarily selected, three points at which the warp yarns float most on the front surface side are also arbitrarily selected, and the thicknesses in the woven base fabric thickness direction at these points are measured for each point. The same measurement is carried out at 10 arbitrary points of the woven hook-and-loop fastener, and the thicknesses in the woven base fabric thickness direction are measured at each point.

Out of a total of 30 measured values of the thicknesses in the woven base fabric thickness direction at the points where the warp yarns sink most on the back surface side and a total of 30 measured values of the thicknesses in the woven base fabric thickness direction at the points where the warp yarns float most on the front surface side, 5 measured values are removed in order from the highest value and 5 measured values are removed in order from the lowest value, and the average value of the remaining 20 measured values is obtained. The respective average values obtained are the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side.

In addition, even if the woven hook-and-loop fastener is pressed against the fixed surface or the roll surface at the time when the heat-fusible resin of the weft yarn is kept in a melted state, not all of the points of the warp yarns present on the back surface of the woven hook-and-loop fastener and sinking most on the back surface side are pressed against the fixed surface or the roll surface, and there are some points in which the thicknesses (Tb) on the back surface side of the warp yarns are almost the same as the thicknesses (Ts) on the front surface side without being pressed against the fixed surface or the roll surface, but in the present invention, such points are included in the arbitrarily selected points. Therefore, it can be said that the (Tb)/(Ts) ratio specified in the present invention is an average value obtained including these points.

On the other hand, FIG. 3 shows the case where the woven hook-and-loop fastener is not pressed against the fixed surface or the roll surface as described above, and in the case of FIG. 3, i.e., when (Tb) and (Ts) have substantially the same value, the effect obtained by using the Step C, i.e., the effect of reducing the occurrence of waving in the vertical direction, or the like of the woven hook-and-loop fastener and further preventing the engaging elements from being pulled out from the woven base fabric by the repetition of engagement and peeling, cannot be obtained.

In the present invention, the ratio of (Tb) to (Ts) is mainly influenced by the pressing strength when pressing the woven base fabric having a loop against a fixed surface or a roll surface, and therefore this value can be freely changed by the tensile force of the woven base fabric having a loop, the degree of changing the traveling direction, the temperature of the woven base fabric, and the like when traveling the woven base fabric having a loop on a fixed surface or a roll surface in a state in which a tensile force is applied, preferably sliding the woven base fabric having a loop while pressing it against the same surface, and changing the traveling direction along the fixed surface or the roll surface as shown in FIG. 1.

In the present invention, when the back surface of the woven base fabric having a loop is pressed against the fixed surface or the roll surface at the time when the heat-fusible component constituting the weft yarn is kept in a molten state, it is preferable that the front surface side of the woven base fabric having a loop in which the loops for engaging elements of the woven hook-and-loop fastener are present is not pressed against the fixed surface or the roll surface. That is, when the woven base fabric having a loop is sandwiched between the rolls and the woven base fabric having a loop is pressed from above and below, the loops for engaging elements standing upright on the front surface of the woven base fabric having a loop are pushed down by the pressing from above and fixed to the front surface of the woven base fabric in that state, so that the engaging ability as the woven hook-and-loop fastener is lowered and the appearance of the woven hook-and-loop fastener is deteriorated. In addition, when both the front surface side and the back surface side of the woven base fabric having a loop are pressed against a fixed surface or a roll surface, (Tb) and (Ts) become substantially equal to each other, and the (Tb)/(Ts) ratio defined in the present invention cannot satisfy 0.94 or less.

Next, the woven fabric having a loop for hook-shaped engaging element on the surface thereof (woven base fabric having a loop) thus obtained is sent to the above-mentioned Step D, and in this Step D, one side portion of the loop for hook-shaped engaging elements is cut. As a cutter used therefor, a cutter having a structure in which one leg of the loop for hook-shaped engaging elements of a woven base fabric for a hook type hook-and-loop fastener or a woven base fabric for a hook-and-loop-coexisting type hook-and-loop fastener traveling in the warp direction is cut between two fixed blades by reciprocating motion of a movable cutter blade is preferable. The woven fabric in which one leg of the loop for hook-shaped engaging element is cut is used as a hook type hook-and-loop fastener or a hook-and-loop-coexisting type hook-and-loop fastener. In particular, in the present invention, since the waving in the vertical direction of the woven base fabric is eliminated by performing the Step C, in the Step D, a point at a certain height of one leg of the loop for hook-shaped engaging element can be easily cut, and as a result, a hook type hook-and-loop fastener in which the cut position is constant, that is, the engaging force is constant is obtained.

The polyester-based hook type hook-and-loop fastener thus obtained is preferably dyed. The dyeing is preferably carried out by high-temperature and high-pressure dyeing using a disperse dye employed for dyeing polyester-based fiber products. That is, the woven hook-and-loop fastener of the present invention is wound into a roll in a long state, to be specific, a woven hook-and-loop fastener 50 to 300 m long is wound into a roll, the roll is placed on a partition plate, a plurality of the partition plates on which the rolls are placed are stacked in the vertical direction and inserted into a dyeing vessel, and a dye solution is circulated in the vessel to bring the woven hook-and-loop fastener into contact with the dye solution.

Specific dyeing conditions include, for example, approximately 120 to 140° C., and approximately 20 to 120 minutes of dyeing. The type of the disperse dye used for dyeing is not particularly limited, and any disperse dye conventionally used for dyeing polyester fibers can be used. Examples of the disperse dye include monoazo dyes, diazo dyes, anthraquinone dyes, nitro dyes, styryl dyes, and methine dyes.

In the woven hook-and-loop fastener of the present invention, waving in the vertical direction can be eliminated by performing the Step C, and when such a woven hook-and-loop fastener is wound in a roll shape, a wound woven hook-and-loop fastener (roll-shaped object) having a uniform interval between the surrounding woven hook-and-loop fastener, that is, a uniform interval between overlapping woven hook-and-loop fastener, is obtained. Therefore, when the woven hook-and-loop fastener wound at such a uniform interval is dyed in a wound state, the contact with the dyeing solution is performed uniformly (that is, the uneven flow of the dyeing solution is small) since the interval is uniform, and a dyed woven hook-and-loop fastener which is dyed uniformly, that is, which has less dyeing speck is obtained. In addition, since the PET yarn used as the warp yarn has a melting peak temperature lower than that of an ordinary PET yarn, it can be dyed in a deep color by dyeing with a disperse dye. Further, the dyeing with a disperse dye is performed at a high temperature and a high pressure for a long time as described above, and at this time, the woven hook-and-loop fastener of the present invention has an advantage that new waving is less likely to occur.

As described above, the woven hook-and-loop fastener having the hook-shaped engaging elements of the present invention is extremely excellent in dyeability. To be specific, the woven hook-and-loop fastener of the present invention has high degree of exhaustion with a degree of exhaustion of 95% or more. The degree of exhaustion defined in the present invention is a value obtained from the amount of dye that has penetrated into the fibers constituting the woven hook-and-loop fastener by dyeing the woven hook-and-loop fastener under the following dyeing conditions. To be specific, the degree of exhaustion is a value obtained by diluting the stock solution before dyeing and the residual solution after dyeing with acetone water (acetone/water=1/1 mixed solution), respectively at any identical magnification using the following absorbance measuring instrument, measuring each absorbance using the following spectrophotometer, and calculating the degree of exhaustion from the value according to the following equation. The following dyeing conditions are very general as a method for dyeing a polyester fiber product, and a method for measuring and calculating the degree of exhaustion is also very general as a means for examining the dyeability of a fiber product.

However, in the case where the degree of exhaustion is more than 97%, although there is no problem in terms of dyeability, uneven shrinkage may occur, though slightly, in the heat treatment step or the dyeing step, and waving in the vertical direction of the woven hook-and-loop fastener may occur. Therefore, in the present invention, the degree of exhaustion of the woven hook-and-loop fastener is preferably 95 to 97%, and more preferably in the range of 95.2 to 96.5%.

[Dyeing Conditions]

Dye; Tuxedo Black H (manufactured by DyStar Co., Ltd.) 4.1% with respect to the weight of woven hook-and-loop fastener tape Auxiliary agent; Nicca SUNSOLT SN130 (manufactured by Nicca Chemical Co., Ltd.) 1 g/L, TEXPORT SN10 (manufactured by Nicca Chemical Co., Ltd.) 0.5 g/L, Lactic Acid 0.1 g/L, PEEL (manufactured by Nicca Chemical Co., Ltd.) 1 g/L, 797 (manufactured by Nicca Chemical Co., Ltd.) 0.1 g/L Bath ratio; 1:15

Dyeing temperature and time; 135° C.×40 minutes (the temperature is raised from 40° C. to 135° C. in 30 minutes, and the temperature is kept at 135° C. for 40 minutes)

Washing; Caustic soda 2 g/L, ESKUDO NEO-2 2 g/L, RC110 2 g/L

Washing temperature and time: 85° C.×15 minutes

Water washing; 15 minutes

Drying; 70° C.×30 minutes

[Absorbance Measuring Instrument]

HITACHI Model 100-40 Spectrophotometer

[Calculation Method of Degree of Exhaustion]

$$\text{Degree of exhaustion} = (A - B)/A \times 100\ (\%)$$

Here, A and B respectively represent the following.

A: Absorbance of stock solution (acetone water-diluted solution)

B: Absorbance of dyeing residual liquid (acetone water-diluted solution)

In the case of the woven hook-and-loop fastener having the hook-shaped engaging elements of the present invention, a dyed product having a degree of exhaustion of 95 to 97% is easily obtained. In contrast, when the woven hook-and-loop fastener having the hook-shaped engaging elements described in the above-mentioned prior art documents is dyed under the same conditions, a dyed product having a degree of exhaustion of less than 95%, to be specific, 92 to 93% is obtained.

As described above, the woven hook-and-loop fastener having hook-shaped engaging elements obtained by performing the Step A, the Step B. and the Step D in this order, and preferably performing the Step C between the Step B and the Step D, and preferably using a yarn produced from PET recovered from a PET bottle as the warp yarn preferably satisfies the condition that the melting peak temperature by DSC measurement of the warp yarn constituting the woven hook-and-loop fastener is in the range of 251.0 to 257.5° C., more preferably satisfies the condition that the molecular weight distribution (Mw/Mn) of the warp yarn constituting the woven hook-and-loop fastener is in the range of 4.0 to 4.5, and further satisfies the (Tb)/(Ts) ratio described above. Furthermore, by using a yarn produced from PET recovered from a PET bottle also as the yarn for hook-shaped engaging elements, the yarn for hook-shaped engaging elements as well as the warp yarn constituting the woven hook-and-loop fastener satisfies the melting peak temperature and the molecular weight distribution range of 3.8 to 4.7 described above, and further satisfies the (Tb)/(Ts) ratio described above, and thus the effect of the present invention is further improved.

In addition, from the viewpoint of obtaining a woven hook-and-loop fastener in which the engaging elements are less likely to be pulled out from the woven base fabric even when engagement and peeling are repeated, the melting peak temperature of the yarn for hook-shaped engaging elements by DSC measurement is preferably in a range of 251.0 to 257.5° C.

In addition, from the viewpoint of obtaining a woven hook-and-loop fastener in which the engaging elements are less likely to be pulled out from the woven base fabric even when engagement and peeling are repeated, it is preferable that the warp yarn and the yarn for hook-shaped engaging elements subjected to the Step A satisfy the following conditions (1) to (3):

(1) the warp yarn has a dry heat shrinkage at 200° C. in a range of 20 to 25%;

(2) the yarn for the hook-shaped engaging elements has a dry heat shrinkage at 200° C. in a range of 22.5 to 27.5%; and (3) the yarn for hook-shaped engaging elements has a dry heat shrinkage at 200° C. higher than that of the warp yarn at 200° C. by 1 to 5%.

In the woven hook-and-loop fastener composed of the warp yarn satisfying such a melting peak temperature, preferably a molecular weight distribution, since the root of the engaging element is firmly fixed to the woven base fabric, the engaging elements are less likely to be pulled out from the woven base fabric even if the engagement and peeling are repeated, and the woven hook-and-loop fastener is dyed in a dark color by the penetration of the disperse dye into the inside of the fiber by high-temperature and high-pressure dyeing, and even if the yarns constituting the woven hook-and-loop fastener are surface-worn by the repetition of the engagement and peeling, there is almost no occurrence of color spots on the woven hook-and-loop fastener. Further, the Step C eliminates the waving in the vertical direction that normally occurs in the heat treatment step of the Step B and the subsequent dyeing step, and it is possible to reliably cut only one leg of the hook-shaped engaging elements, and to more firmly fix the engaging elements to the woven base fabric.

Therefore, the woven hook-and-loop fastener of the present invention has an extremely high value as the pull-out force of the hook-shaped engaging elements from the woven base fabric. In the present invention, the pull-out force from the woven base fabric of the hook-shaped engaging elements achieves an extremely high value because the warp yarn is composed of a yarn having a low melting peak temperature, the warp yarn and the heat-fusible yarn are firmly bonded, the woven hook-and-loop fastener constituent yarns are all heat-shrinkable yarns, and the root of the hook-shaped engaging element is firmly tightened thereby, the root of the hook-shaped engaging element is preferably fixed by the fusion of the molten resins from the heat-fusible component because the hook-shaped engaging elements are also yarns having a low melting peak temperature, and the resins constituting the yarn for hook-shaped engaging elements have excellent fusion properties with the molten resins, and the bonding force between the heat-fusible component and the yarns for engaging elements is further increased by the operation of pressing the back surface of the woven base fabric to the fixed surface or the roll surface while the heat-fusible component are melted, which is performed after the heat treatment.

The pull-out force of the hook-shaped engaging elements referred to herein is a value obtained by measuring the maximum strength when the hook-shaped engaging elements are pulled out from the woven base fabric of the woven hook-and-loop fastener, and in the case of a hook-and-loop-coexisting type hook-and-loop fastener, it means a value of the pull-out force of the hook-shaped engaging elements. In the present invention, 10 pieces were randomly selected, their pull-out forces were measured, and their average value was adopted.

The woven hook-and-loop fastener having the hook-shaped engaging elements of the present invention can be used in application fields in which conventional general woven hook-and-loop fasteners are used, for example, in the case of a hook type hook-and-loop fastener or a hook-and-loop coexistence type hook-and-loop fastener, it can be used in a wide range of fields such as blood pressure monitors, supporters, binding bands for packaging, binding tapes, various toys, fixing of sheets for civil engineering and construction, fixing of various panels and wall materials, fixing of electric parts, storage boxes and packaging cases that can be assembled and disassembled, small articles, curtains, etc., in addition to clothes, shoes, bags, hats, gloves, etc., and is particularly suitable for application fields in which the woven hook-and-loop fastener is attached to cloth or sheets by sewing, for example, fields such as clothes, shoes, bags, hats, gloves, supporters, etc. Further, in the case of a woven hook-and-loop fastener with a hook on one side and a loop on one side, it is particularly suitable as a binding string or a binding tape.

In particular, the present invention is suitable for a polyester-based fiber product which is dyed with a disperse dye after a woven hook-and-loop fastener is attached thereto, and is suitable for an application in which the woven hook-and-loop fastener of the present invention is attached to the polyester-based fiber product by sewing or the like, and then the fiber product is dyed with the disperse dye simultaneously with the woven hook-and-loop fastener. In the woven hook-and-loop fastener of the present invention, the engaging force, the melting peak temperature, and the molecular weight distribution hardly change before and after dyeing.

Hereinafter, the present invention will be described in more detail with reference to Examples. In the Examples, the engaging force of the woven hook-and-loop fastener was measured in accordance with JIS L 3416:2020. The dry heat shrinkage of the yarn used was determined by selecting 10 yarns, measuring their dry heat shrinkage, and averaging the measured values. As a woven hook-and-loop fastener to be engaged, B2790Y (manufactured by Kuraray Fastening Co., Ltd.) was used as the loop type hook-and-loop fastener when the woven hook-and-loop fastener of Examples and Comparative Examples was a woven hook-and-loop fastener in which only the hook-shaped engaging elements were present on only one surface of the woven base fabric, and when the woven hook-and-loop fastener of Examples and Comparative Examples was a hook-and-loop-coexisting type hook-and-loop fastener, the same hook-and-loop-coexisting type hook-and-loop fastener was used.

Details of the warp yarn, the weft yarn, the monofilament yarn for hook-shaped engaging elements, and the multifilament yarn for loop-shaped engaging elements used in Examples and Comparative Examples, and the results of measurement of woven hook-and-loop fastener are shown in Table 1.

In the yarns used in Examples and Comparative Examples, the fiber-grade PET means a yarn obtained by spinning ordinary PET polymerized for fibers as it is, and does not mean a yarn using PET recovered from a PET bottle or the like.

Example 1

The following yarns were prepared as the warp yarn and weft yarn constituting the woven base fabric of the hook type hook-and-loop fastener and as the monofilament yarn for hook-shaped engaging elements.

[Warp Yarn]

- Multifilament yarn made of PET (ECOPET Material Recycle 100%: made of recovered PET, manufactured by Teijin Limited)
- Total dtex and number of filaments: 30 in 167 dtex
- Dry heat shrinkage at 200° C.: 22.1%
- Melting peak temperature by DSC measurement: 256.0° C.
- Molecular weight distribution (Mw/Mn) by GPC measurement: 4.2
- Weight-average molecular weight (Mw) by GPC measurement: 19900

[Weft Yarn (Multifilament-Based Heat-Fusible Yarn Made of Core-Sheath Type Composite Fiber)]

- Core component: fiber grade PET
- Sheath component: 25 mol % isophthalic acid-copolymerized PET (softening point: 190° C.)
- Core-sheath ratio (weight ratio): 70:30
- Total dtex and number of filaments: 48 in 220 dtex
- Dry heat shrinkage at 200° C.: 17.1%

[Monofilament Yarn for Hook-Shaped Engaging Elements]

- Monofilament yarn made of PET (ECORON Material Recycle 100%: made of recovered PET, manufactured by Takada Kasei Kogyo K.K.)
- Diameter (before heat shrinkage): 0.19 mm
- Dry heat shrinkage at 200° C.: 24.2%
- Melting peak temperature by DSC measurement: 256.5° C.
- Molecular weight distribution (Mw/Mn) by GPC measurement: 3.9
- Weight-average molecular weight (Mw) by GPC measurement: 18000

[Production of Hook Type Hook-and-Loop Fastener]

Using the warp yarn, the weft yarn, and the monofilament yarn for hook-shaped engaging elements described above, a plain weave was used as the weaving structure, the weaving density (after heat shrinkage treatment) was 55 yarns/cm for the warp yarns and 18.9 yarns/cm for the weft yarns, and the monofilament yarns for hook-shaped engaging elements were driven in parallel with the warp yarns at a ratio of one per four warp yarns, five weft yarns were allowed to float and sink and then allowed to straddle three warp yarns, and a loop was formed on the woven base fabric so as to form a loop at the straddling portion. When the loops for hook-shaped engaging elements are formed, a method was used in which a plurality of metal rods are arranged on the woven base fabric in parallel with the warp yarns at positions where the yarns for hook-shaped engaging elements straddle the warp yarns, the yarns for engaging elements are passed over the metal rods to form loops, and the metal rods are pulled out from the loops after the loops are formed.

The hook type hook-and-loop fastener tape woven under the above conditions was subjected to heat treatment by traveling a heat treatment oven for 60 seconds at a temperature of 200° C., which is a temperature at which only the sheath component of the weft yarn is heat-melted and at which the warp yarn, the multifilament yarn for loop engaging elements, and the core component of the weft yarn are not heat-melted, thereby shrinking the weft yarn, the weft yarn, and the monofilament yarn for hook-shaped engaging elements. As a result, the tape was shrunk by 11% in the weft direction, and the sheath component was melted to fuse the yarns existing in the vicinity.

Then, as shown in FIG. 1, in a state in which the heat-fusible component was kept in a molten state maintained in a molten state, the woven tape for a hook type hook-and-loop fastener was slid on a fixed surface made of stainless steel having a mirror-finished surface installed right next to the outlet of the heat treatment oven, the tape was caused to travel in a state in which a tensile force of 320 g/cm was applied after passing through the fixed surface, and the back surface of the tape was pressed against the fixed surface for 5 seconds using the residual heat of the heat treatment step, that is, at a temperature equal to or lower than the temperature of the heat treatment step, and the traveling direction was bent by 90 degrees along the fixed surface. Then, the obtained woven fabric was cooled, and one leg portion of the loop for hook-shaped engaging element was cut to form hook-shaped engaging elements. From the step of weaving the woven fabric (woven base fabric having a loop) to the step of performing heat treatment and the step of cutting one leg, the process was continuously performed without winding.

As a result, in the heat treatment step, the waving of the hook type hook-and-loop fastener in the vertical direction was not observed at all, and as a result, the cutting of one leg of the hook-shaped engaging elements could be performed without any problem.

The density of the hook-shaped engaging elements of the obtained woven fabric for the hook type hook-and-loop fastener was 45 pieces/cm$^2$, and the height of the hook-shaped engaging elements from the woven base fabric surface was 1.5 mm.

In the hook type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb)/(Ts) was 0.89.

Next, when the warp yarns and the yarns for hook-shaped engaging elements constituting the hook type hook-and-loop fastener were taken out from the hook type hook-and-loop fastener and the melting peak temperature was measured by DSC measurement, the melting peak temperature of the warp yarns was 257.3° C., and the melting peak temperature of the yarns for hook-shaped engaging elements was 252.4° C.

As a result of measuring the pull-out force of the hook-shaped engaging elements of this hook type hook-and-loop fastener, it was found to be 10.01 N and extremely excellent in pull-out resistance. In addition, in order to observe the presence or absence of waving in the vertical direction of the hook type hook-and-loop fastener, the hook type hook-and-loop fastener was placed in parallel on a flat glass plate, and as a result, waving was not observed.

Further, when the engaging force of this hook type hook-and-loop fastener was measured, the initial engaging force was 14.9 N/cm$^2$ in shear strength and 1.32 N/cm in peel strength, and the engaging force after IWO times of engagement and peeling was 14.3 N/cm$^2$ in shear strength and 1.28 N/cm in peel strength, and no hook-shaped engaging elements pulled out from the surfaces of the hook type hook-and-loop fastener were observed even after 1000 times of engagement and peeling were repeated, and it was found that the hook type hook-and-loop fastener was excellent even in the absence of the back coat layer.

Furthermore, when this hook type hook-and-loop fastener was dyed under the above-mentioned conditions, a hook type hook-and-loop fastener dyed in a deep color with a degree of exhaustion of 95.6% was obtained, and it was found that the hook type hook-and-loop fastener was excellent in dyeability, did not cause waving in the vertical direction when dyed, did not expose the undyed inner layer even when the surface of the hook-shaped engaging element was lightly rubbed with sandpaper, and was excellent in being dyed to the inner layer. The presence or absence of waving of the hook type hook-and-loop fastener after the dyeing was also observed, and no waving was observed. The pull-out resistance of the hook-shaped engaging elements of the hook type hook-and-loop fastener after the dyeing was the same as the value before the dyeing. A part of the hook-shaped engaging elements and a part of the warp yarns were extracted from the dyed hook type hook-and-loop fastener and subjected to GPC analysis, and as a result, the molecular weight distributions (Mw/Mn) were 4.0 for the hook-shaped engaging elements and 4.2 for the warp yarns, and the weight-average molecular weights (Mw) were 17400 for the hook-shaped engaging elements and 19000 for the warp yarns.

Comparative Example 1

A hook type hook-and-loop fastener was produced by the same method as in Example 1 except that the multifilament yarn used as the warp yarn and the monofilament yarn used as the yarn for hook-shaped engaging elements in Example 1 were changed to the following yarns and the tensile force after passing through the fixed surface was set to 80 g/cm. The shrinkage rate in the weft direction of the tape under the heat treatment conditions was 11%. The weaving density (after heat shrinkage treatment) was 16.1 yarns/cm for the weft yarns.

[Warp Yarn]

- Multifilament yarn made of PET (high-shrinkage yarn made of fiber grade PET manufactured by Teijin Limited)
- Total dtex and number of filaments: 30 in 167 dtex
- Dry heat shrinkage at 200° C.: 18.8%
- Melting peak temperature by DSC measurement: 261.4° C.
- Molecular weight distribution (Mw/Mn) by GPC measurement: 4.6
- Weight-average molecular weight (Mw) by GPC measurement: 18200

[Monofilament Yarn for Hook-Shaped Engaging Elements]

- Monofilament yarn made of PET (high-shrinkage yarn made of fiber grade PET manufactured by Takada Kasei Kogyo K.K.)
- Diameter (before heat shrinkage): 0.19 mm
- Dry heat shrinkage at 200° C.: 21.4%
- Melting peak temperature by DSC measurement: 260.7° C.
- Molecular weight distribution (Mw/Mn) by GPC measurement: 5.0
- Weight-average molecular weight (Mw) by GPC measurement: 21000

The density of the hook-shaped engaging elements of the obtained woven fabric for the hook type hook-and-loop fastener was 38 pieces/cm$^2$, and the height of the hook-shaped engaging elements from the woven base fabric surface was 1.3 mm. When the hook type hook-and-loop fastener was observed in detail, hook-shaped engaging elements whose roots were not reliably cut were slightly observed.

Further, when the warp yarns and the yarns for engaging elements constituting the hook type hook-and-loop fastener were taken out from the hook type hook-and-loop fastener and the melting peak temperature was measured by DSC measurement, the melting peak temperature of the warp yarns was 261.5° C., and the melting peak temperature of the yarns for hook-shaped engaging elements was 258.3° C.

Then, as a result of measuring the pull-out force of the hook-shaped engaging elements of this hook type hook-and-loop fastener, it was found that the pull-out force was 7.26 N, which was inferior to that of Example 1. Further, when this hook type hook-and-loop fastener was repeatedly engaged with and peeled off from the loop type hook-and-loop fastener 1000 times, it was observed that the hook-shaped engaging elements were pulled out from the woven base fabric and protruded from the surfaces of the hook-and-loop fastener, although this was very slight.

When this hook type hook-and-loop fastener was dyed under the above-mentioned dyeing conditions, a hook type hook-and-loop fastener dyed with a degree of exhaustion of 92.2% was obtained. When the color tones of this dyed hook-and-loop fastener and the dyed hook-and-loop fastener of Example 1 were compared, most people pointed out that the hook-and-loop fastener of this Comparative Example was slightly lighter in color and less deep in color. Further, when the surfaces of the hook-and-loop fastener after dyeing were lightly rubbed with sandpaper, the undyed inner layer of the hook-shaped engaging element was slightly exposed. The pull-out resistance of the hook-shaped engaging elements of the hook-and-loop fastener after the dyeing was the same as the value before the dyeing. Then, a part of the hook-shaped engaging elements and a part of the warp yarns were extracted from the dyed hook type hook-and-loop fastener and subjected to GPC analysis, and as a result, the molecular weight distributions (Mw/Mn) were 4.9 for the hook-shaped engaging elements and 4.7 for the warp yarns, and the weight-average molecular weights (Mw) were 20600 for the hook-shaped engaging elements and 17800 for the warp yarns.

Comparative Example 2

A hook type hook-and-loop fastener was produced in the same manner as in Comparative Example 1 except that, in Comparative Example 1, while the heat-treated heat-fusible multifilament yarn was kept in a molten state, the back surface side of the woven base fabric having a loop was not pressed against a fixed surface made of stainless steel installed right next to the outlet of the heat treatment oven, and the hook type hook-and-loop fastener tape was taken up by a roller after being cooled.

The density of the hook-shaped engaging elements of the obtained hook type hook-and-loop fastener was 38 pieces/$cm^2$, and the height of the hook-shaped engaging elements from the woven base fabric surface was 1.3 mm, and when the hook type hook-and-loop fastener was placed side by side on a horizontal glass plate, large wavings in the vertical direction were observed at various places, and among the hook-shaped engaging elements, those which were not accurately cut at the root of one leg and remained in a loop shape, those which were cut at both legs and did not have a hook shape, and those which were cut only to the middle of one leg were observed. Further, as a result of measuring the pull-out force of the hook-shaped engaging elements, it was found that the pull-out force was 6.45 N, which was far inferior to that of Example 1 and also inferior to that of Comparative Example 1.

Then, when the warp yarns and the yarns for hook-shaped engaging elements constituting the hook type hook-and-loop fastener were taken out from the hook type hook-and-loop fastener and the melting peak temperature was measured by DSC measurement, the melting peak temperature of the warp yarns was 261.8° C., and the melting peak temperature of the yarns for hook-shaped engaging elements was 258.1° C. In the hook type hook-and-loop fastener, when the warp yarn thickness (Tb) in the woven base fabric direction at the position where the warp yarn sinks most on the back surface side and the warp yarn thickness (Ts) in the woven base fabric thickness direction at the position where the warp yarn floats most on the front surface side were measured, (Tb)/(Ts) was 0.97.

Further, when this hook type hook-and-loop fastener was repeatedly engaged with and peeled off from the loop type hook-and-loop fastener 1000 times, it was observed that the hook-shaped engaging elements were pulled out from the woven base fabric and protruded from the surfaces of the hook type hook-and-loop fastener much more frequently than in Comparative Example 1.

When this hook type hook-and-loop fastener was dyed under the above-mentioned dyeing conditions, the degree of exhaustion (91.7%) was inferior to that of the hook type hook-and-loop fastener of Comparative Example 1. When the color tones of this dyed hook type hook-and-loop fastener and the dyed hook type hook-and-loop fastener of Example 1 were compared, as in the case of the hook type hook-and-loop fastener of Comparative Example 1, most people pointed out that the hook type hook-and-loop fastener of this Comparative Example was lighter in color, had no depth of color, and further had color spots. Further, in the dyeing step, the hook type hook-and-loop fastener was further unevenly shrunk, so that slight waving was frequently generated in the vertical direction, and when the surface of the dyed hook-shaped engaging element was lightly rubbed with sandpaper, the undyed monofilament inner layer was exposed as compared with the case of the hook type hook-and-loop fastener of Comparative Example 1, giving a cheap impression. Further, when the pull-out resistance of the hook-shaped engaging elements of this hook type hook-and-loop fastener after the dyeing was examined, it was the same low value as the value before the dyeing.

Example 2

A hook type hook-and-loop fastener was produced by the same method as in Example 1, except that the yarn used as the monofilament yarn for hook-shaped engaging elements in Example 1 was replaced with the monofilament yarn for hook-shaped engaging elements made of the fiber grade PET described in Comparative Example 1. The density of the hook-shaped engaging elements of the obtained hook type hook-and-loop fastener was 43 pieces/$cm^2$, and the height of the hook-shaped engaging elements from the woven base fabric surface was 1.5 mm.

In the hook type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb)/(Ts) was 0.90.

When the warp yarns and the yarns for engaging elements constituting the hook type hook-and-loop fastener were taken out from the hook type hook-and-loop fastener and the melting peak temperature was measured by DSC measurement, the melting peak temperature of the warp yarns was 257.3° C., and the melting peak temperature of the yarns for engaging elements was 258.7° C. As a result of measuring the pull-out force of the hook-shaped engaging elements of the hook type hook-and-loop fastener, the pull-out force was 9.43 N, which was slightly inferior to that of Example 1, but had an excellent value.

Next, when the engaging force of this hook type hook-and-loop fastener was measured, the initial engaging force was 14.2 N/$cm^2$ in shear strength, 1.26 N/cm in peel strength, and the engaging force after 1000 times of engagement and peeling was 13.7 N/cm$^2$ in shear strength and 1.21 N/cm in peel strength. Even after 1000 times of engagement and peeling, almost no hook-shaped engaging elements pulled out from the surfaces of the hook type hook-and-loop fastener were seen, and no waving was seen in the vertical direction. Furthermore, one leg of the hook-shaped engaging element was also cut without any problem. From the above, it was found that this hook type hook-and-loop fastener was excellent.

When this hook type hook-and-loop fastener was dyed under the above-mentioned dyeing conditions, a hook type hook-and-loop fastener dyed in a dark color with a degree of exhaustion of 95.2% was obtained. Although the undyed inner layer was slightly exposed by rubbing the surface of the hook-shaped engaging element after the dyeing with sandpaper, the slight color change of the hook-shaped engaging elements was practically not problematic because the woven base fabric surface was dyed in a dark color. In addition, the hook type hook-and-loop fastener did not shrink unevenly in the dyeing step to cause waving in the vertical direction. Further, the hook-and-loop fastener after the dyeing was excellent in the pull-out resistance of the hook-shaped engaging elements as well as in the value before the dyeing.

A part of the hook-shaped engaging elements and a part of the warp yarns were extracted from the dyed hook type hook-and-loop fastener and subjected to GPC analysis, and as a result, the molecular weight distribution (Mw/Mn) was 4.2 for the warp yarns and 4.9 for the hook-shaped engaging elements.

Example 3

A hook-and-loop-coexisting type hook-and-loop fastener was produced using the following multifilament yarn for loop-shaped engaging elements in addition to the warp yarn, the weft yarn, and the monofilament yarn for hook-shaped engaging elements used in Example 1. A plain weave was used as the weaving structure at that time, the weaving density (after heat shrinkage treatment) was 55 yarns/cm for the warp yarns and 18.5 yarns/cm for the weft yarns, and a loop was formed on the woven base fabric at a ratio of one per four warp yarns of a multifilament yarn for loop-shaped engaging elements or a monofilament yarn for hook-shaped engaging elements, in the case of the multifilament yarn for loop-shaped engaging elements, three weft yarns were allowed to float and sink, and then allowed to straddle one warp yarn, and a loop was formed on the woven base fabric so as to form a loop at a position straddling one warp yarn by driving in parallel with the warp yarn, and in the case of the monofilament yarn for hook-shaped engaging elements, three weft yarns were allowed to float and sink and then allowed to straddle three warp yarns, and a loop was formed on the woven base fabric so as to form a loop at the straddling portion. At this time, the multifilament yarn for loop-shaped engaging elements and the monofilament yarn for hook-shaped engaging elements were woven alternately so that each of the multifilament yarn for loop-shaped engaging elements and the monofilament yarn for hook-shaped engaging elements were continuously present in units of two yarns.

[Multifilament Yarn for Loop-Shaped Engaging Elements]

A high-shrinkage multifilament yarn made of PBT blended with 5 wt % of polytrimethylene terephthalate (melting temperature: 220° C.)

Total dtex and number of filaments: 8 in 305 dtex

Dry heat shrinkage at 200° C.: 16.6%

The woven hook-and-loop-coexisting type hook-and-loop fastener tape was subjected to a heat treatment by traveling the tape in a heat treatment oven for 60 seconds at 200° C., which is a temperature at which only the sheath component of the weft yarn is heat-melted and the warp yarn, the yarn for engaging elements, and the core component of the weft yarn are not heat-melted. Next, as shown in FIG. 1, in a state in which the heat-fusible component was kept in a molten state, a woven tape for a hook-and-loop-coexisting type hook-and-loop fastener was slid on a fixed surface made of stainless steel having a mirror-finished surface installed right next to the outlet of the heat treatment oven, the tape was caused to travel in a state in which a tensile force of 320 g/cm was applied after passing through the fixed surface, and the back surface of the tape was pressed against the fixed surface for 5 seconds using the residual heat of the heat treatment step, and the traveling direction was bent by 90 degrees along the fixed surface. As a result, the weft yarn, the weft yarn, and the yarn for engaging elements were shrunk, the tape was shrunk by 11% in the weft direction, and the sheath component was melted to fuse the yarns existing in the vicinity. Then, the obtained woven fabric (woven base fabric having a loop) was cooled, and subsequently, one leg portion of the loop for hook-shaped engaging element was cut to form hook-shaped engaging elements.

The densities of the hook-shaped engaging elements and the loop-shaped engaging elements in the hook-and-loop-coexisting type hook-and-loop fastener thus obtained were 32 pieces/cm$^2$ and 32 pieces/cm$^2$, respectively, and the height of the hook-shaped engaging elements from the woven base fabric surface was 1.6 mm and the height of the loop-shaped engaging elements from the woven base fabric was 2.1 mm. The steps from the step of weaving a woven fabric (woven base fabric having a loop) to the step of performing heat treatment, and further to the step of cutting one leg of the loop for hook-shaped engaging element were continuously performed without winding the fabric in the middle.

As a result, in the obtained hook-and-loop-coexisting type hook-and-loop fastener, as in Example 1 and Example 2, waving in the vertical direction of the woven hook-and-loop fastener was not observed at all in the heat treatment step, and as a result, cutting of one leg of the hook-shaped engaging elements could be performed without any problem. Then, in the hook-and-loop-coexisting type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb) and (Ts) shown in FIG. 2 were 0.089 mm and 0.102 mm, respectively, and therefore (Tb)/(Ts) was 0.87.

Further, when the warp yarns and the yarns for hook-shaped engaging elements constituting the hook-and-loop-coexisting type hook-and-loop fastener were taken out from the hook-and-loop fastener and the melting peak temperature was measured by DSC measurement, the melting peak temperature of the warp yarns was 255.2° C., and the melting peak temperature of the yarns for hook-shaped engaging elements was 253.8° C. Then, as a result of measuring the pull-out force of the hook-shaped engaging elements of this hook-and-loop fastener, it was found to be 7.61 N and excellent in pull-out resistance.

Further, when the engaging force of this hook-and-loop-coexisting type hook-and-loop fastener was measured, the initial engaging force was 10.3 N/cm$^2$ in shear strength, 1.42 N/cm in peel strength, and the engaging force after 1000 times of engagement and peeling was 9.0 N/cm$^2$ in shear strength and 1.29 N/cm in peel strength, and it had an excellent engaging force as a hook-and-loop-coexisting type hook-and-loop fastener, and no hook-shaped engaging elements were found to be pulled out from the woven base fabric even after 1000 times of engagement and peeling were repeated.

When this hook-and-loop-coexisting type hook-and-loop fastener was dyed under the above-described dyeing conditions, a hook-and-loop-coexisting type hook-and-loop fastener dyed in a deep color with a degree of exhaustion of 95.8% was obtained, and it was found that the hook-and-loop-coexisting type hook-and-loop fastener had extremely excellent dyeability. Further, even when the surface of the hook-shaped engaging element after dyeing was lightly rubbed with sandpaper, the undyed inner layer was not exposed. In addition, the hook-and-loop-coexisting type hook-and-loop fastener did not shrink unevenly in the dyeing step to cause waving in the vertical direction, and the hook-shaped engaging elements of the hook-and-loop-coexisting type hook-and-loop fastener after the dyeing had the same excellent pull-out resistance as that before the dyeing. Then, the yarns for hook-shaped engaging elements and the warp yarns were extracted from the dyed hook-and-loop-coexisting type hook-and-loop fastener and subjected to GPC measurement, and as a result, the molecular weight distribution and the weight-average molecular weight were substantially the same values as those in Example 1.

Comparative Example 3

A hook-and-loop-coexisting type hook-and-loop fastener was produced in the same method as in Example 3, except that the multifilament yarn used as the warp yarn and the monofilament yarn used as the yarn for hook-shaped engaging elements in Example 3 were changed to the yarns described in Comparative Example 1. The shrinkage rate in the weft direction of the tape under the heat treatment conditions was 11%. The weaving density (after heat shrinkage treatment) was 15.7 yarns/cm for the weft yarns.

The obtained hook-and-loop-coexisting type hook-and-loop fastener had no waving, the densities of the hook-shaped engaging elements and the loop-shaped engaging elements in the hook-and-loop-coexisting type hook-and-loop fastener were 27 pieces/cm$^2$ and 27 pieces/cm$^2$, respectively, and the height of the hook-shaped engaging elements from the woven base fabric surface was 1.8 mm and the height of the loop-shaped engaging elements from the woven base fabric was 2.1 mm.

Further, when the warp yarns and the yarns for hook-shaped engaging elements constituting the hook-and-loop-coexisting type hook-and-loop fastener were taken out from the hook-and-loop-coexisting type hook-and-loop fastener and the melting peak temperature was measured by DSC measurement, the melting peak temperature of the warp yarns was 261.6° C., and the melting peak temperature of the yarns for hook-shaped engaging elements was 257.9° C. Then, as a result of measuring the pull-out forth of the hook-shaped engaging elements of this hook-and-loop-coexisting type hook-and-loop fastener, the pull-out force was 4.45 N, and it was found that the pull-out resistance was considerably inferior to that of Example 3.

After the engagement and peeling were repeated 1000 times, the surfaces of the hook-and-loop-coexisting type hook-and-loop fastener were observed, and it was found that the hook-shaped engaging elements were pulled out from the woven base fabric, although slightly, and that the high-quality feeling of the hook-and-loop-coexisting type hook-and-loop fastener was hindered. Further, when this hook-and-loop-coexisting type hook-and-loop fastener was dyed under the above-described conditions, the degree of exhaustion was 92.4%, and it was found that the hook-and-loop-coexisting type hook-and-loop fastener was greatly inferior to that of Example 3 in terms of deepness of color.

Further, the pull-out resistance of the hook-shaped engaging elements of the hook-and-loop-coexisting type hook-and-loop fastener after the dyeing was the same low value as the value before the dyeing. Furthermore, when the surface of the hook-shaped engaging element after dyeing was lightly rubbed with sandpaper, the undyed inner layer was slightly exposed as in Comparative Example 1. Then, the yarns for hook-shaped engaging elements and the warp yarns were extracted from the dyed hook-and-loop-coexisting type hook-and-loop fastener and subjected to GPC measurement, and as a result, the molecular weight distribution and the weight-average molecular weight were substantially the same values as those in Comparative Example 1.

Example 4

A hook-and-loop-coexisting type hook-and-loop fastener was produced in the same method as in Example 3, except that the monofilament yarn used as the yarn for hook-shaped engaging elements in Example 3 was changed to the monofilament yarn for hook-shaped engaging elements described in Comparative Example 1. At this time, as in the case of Examples 1 to 3 described above, in the heat treatment step, the waving of the hook-and-loop fastener in the vertical direction was not observed at all, and as a result, the cutting of one leg of the hook-shaped engaging elements could be performed without any problem. The shrinkage rate in the weft direction of the tape under the heat treatment conditions was 11%, and the weaving density (after heat shrinkage treatment) was 18.1 yarns/cm for weft yarns. The, the steps from the step of weaving a woven fabric to the step of performing heat treatment, and further to the step of cutting one leg of the loop for hook-shaped engaging element were continuously performed without winding the fabric in the middle.

Then, densities of the hook-shaped engaging elements and the loop-shaped engaging elements in the hook-and-loop-coexisting type hook-and-loop fastener thus obtained were 32 pieces/cm$^2$ and 32 pieces/cm$^2$, respectively, and the height of the hook-shaped engaging elements from the woven base fabric surface was 1.7 mm and the height of the loop-shaped engaging elements from the base fabric was 2.1 mm. In the hook-and-loop-coexisting type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb)/(Ts) was 0.90.

Further, when the warp yarns and the yarns for hook-shaped engaging elements constituting the hook-and-loop-coexisting type hook-and-loop fastener were taken out from the hook-and-loop-coexisting type hook-and-loop fastener and the melting peak temperature was measured by DSC measurement, the melting peak temperature of the warp yarns was 255.2° C., and the melting peak temperature of the yarns for hook-shaped engaging elements was 259.0° C.

Then, as a result of measuring the pull-out force of the hook-shaped engaging elements of this hook-and-loop-coexisting type hook-and-loop fastener, it was found to be 7.47 N and excellent in pull-out resistance.

Next, when the engaging force of this hook-and-loop-coexisting type hook-and-loop fastener was measured, the initial engaging force was 10.1 N/cm$^2$ in shear strength, 1.32 N/cm in peel strength, and the engaging force after 1000 times of engagement and peeling was 8.7 N/cm$^2$ in shear strength and 1.27 N/cm in peel strength, and it had an excellent engaging force as a hook-and-loop-coexisting type hook-and-loop fastener, and no hook-shaped engaging elements were found to be pulled out from the woven base fabric even after 1000 times of engagement and peeling were repeated.

When this hook-and-loop-coexisting type hook-and-loop fastener was dyed under the above-described dyeing conditions, a hook-and-loop-coexisting type hook-and-loop fastener dyed in a deep color with a degree of exhaustion of 95.4% was obtained, and it was found that the hook-and-loop-coexisting type hook-and-loop fastener had extremely excellent dyeability. In addition, the hook-and-loop-coexisting type hook-and-loop fastener did not shrink unevenly in the dyeing step to cause waving in the vertical direction, and the hook-shaped engaging elements of the hook-and-loop-coexisting type hook-and-loop fastener after the dyeing had the same excellent pull-out resistance as that before the dyeing. Then, the warp yarns and the yarns for hook-shaped engaging elements were extracted from the dyed hook-and-loop-coexisting type hook-and-loop fastener and subjected to GPC measurement, and as a result, both the molecular weight distribution and the weight-average molecular weight were substantially the same values as those in Example 1.

Comparative Example 4

A hook-and-loop-coexisting type hook-and-loop fastener was produced in the same manner as in Example 3, except that the warp yarn in Example 3 was replaced with the warp yarn made of the fiber grade PET described in Comparative Example 1. The hook-and-loop-coexisting type hook-and-loop fastener thus obtained was repeatedly engaged and peeled 1000 times, and when the surfaces were observed, it was found that the hook-shaped engaging elements were slightly pulled out from the woven base fabric.

When the yarns for hook-shaped engaging elements were taken out from the hook-and-loop-coexisting type hook-and-loop fastener and the melting peak temperatures thereof were measured by DSC measurement, the melting peak temperature of the warp yarns was 261.4° C. and the melting peak temperature of the yarns for hook-shaped engaging elements was 253.4° C. Further, as a result of measuring the pull-out forth of the hook-shaped engaging elements of the obtained hook-and-loop-coexisting type hook-and-loop fastener, the pull-out force was 4.85 N, and it was found that the pull-out resistance was inferior to that of Example 3.

Further, when the obtained hook-and-loop-coexisting type hook-and-loop fastener was dyed under the above-described conditions, the degree of exhaustion was 93.4%, and it was found that the hook-and-loop-coexisting type hook-and-loop fastener was inferior to that of Example 3 in terms of deepness of color. In particular, in the case of this hook-and-loop fastener, the woven base fabric seen from the gaps between the engaging elements looked whiter than the engaging elements, and it has been pointed out that there was a slight problem in terms of color density in the evaluation of a person engaged in dyeing. Further, the pull-out resistance of the hook-shaped engaging elements of the hook-and-loop-coexisting type hook-and-loop fastener after the dyeing was inferior to that of Example 2 which was the same value as that before the dyeing.

Then, the yarns for hook-shaped engaging elements and the warp yarns were extracted from the dyed hook-and-loop-coexisting type hook-and-loop fastener and subjected to GPC measurement, and as a result, with respect to the molecular weight distribution and the weight-average molecular weight, the same values as those of the warp yarn of Comparative Example 1 and the yarn for hook-shaped engaging elements of Example 1 were obtained for the warp yarn and the yarn for hook-shaped engaging elements.

Example 5

A hook-and-loop-coexisting type hook-and-loop fastener was produced in the same manner as in Example 3, except that the core-sheath type multifilament yarn used as the weft yarn in Example 3 was replaced with the following multifilament yarn.

[Weft Yarn (Multifilament-Based Heat-Fusible Yarn Made of Core-Sheath Type Composite Fiber)]

Core component: PET for fiber

Sheath component: 25 mol % isophthalic acid-copolymerized PET (softening point: 190° C.)

Core-sheath ratio (weight ratio): 70:30

Total dtex and number of filaments: 48 in 220 dtex

Dry heat shrinkage at 200° C.: 16.2%

(A heat-fusible multifilament yarn manufactured by Kuraray Co., Ltd. and using recovered PET as the core component)

The densities of the hook-shaped engaging elements and the loop-shaped engaging elements in the hook-and-loop-coexisting type hook-and-loop fastener thus obtained were 32 pieces/cm$^2$ and 32 pieces/cm$^2$, respectively, and the height of the hook-shaped engaging elements from the woven base fabric surface was 1.6 mm and the height of the loop-shaped engaging elements from the base fabric was 2.1 mm. In the hook-and-loop-coexisting type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb)/(Ts) was 0.89.

When the warp yarns and the yarns for hook-shaped engaging elements constituting the hook-and-loop-coexisting type hook-and-loop fastener were taken out from the hook-and-loop-coexisting type hook-and-loop fastener and the melting peak temperature was measured by DSC measurement, the melting peak temperature of the warp yarns was 255.6° C., and the melting peak temperature of the yarns for hook-shaped engaging elements was 254.0° C. Then, as a result of measuring the pull-out force of the hook-shaped engaging elements of this hook-and-loop-coexisting type hook-and-loop fastener, the pull-out force was 7.22 N, which was an excellent value.

When the surfaces of the obtained hook-and-loop-coexisting type hook-and-loop fastener were observed, as in the case of Examples 1 to 4, the hook-and-loop-coexisting type hook-and-loop fastener did not cause waving in the vertical direction in the heat treatment step, and as a result, cutting of one leg of the hook-shaped engaging elements could be performed without any problem.

Then, when the engaging force of this hook-and-loop-coexisting type hook-and-loop fastener was measured, the initial engaging force was 10.8 N/cm$^2$ in shear strength, 1.49 N/cm in peel strength, and the engaging force after 1000 times of engagement and peeling was 9.2 N/cm$^2$ in shear strength and 1.35 N/cm in peel strength, and it had an excellent engaging force as a hook-and-loop-coexisting type hook-and-loop fastener, and no hook-shaped engaging elements were found to be pulled out from the woven base fabric even after 1000 times of engagement and peeling were repeated.

When this hook-and-loop-coexisting type hook-and-loop fastener was dyed under the above-described dyeing conditions, a hook-and-loop-coexisting type hook-and-loop fastener dyed in a deep color with a degree of exhaustion of 96.2% was obtained, and it was found that the hook-and-loop-coexisting type hook-and-loop fastener had extremely excellent dyeability. Further, it was found that even when the surface of the hook-shaped engaging element after dyeing was lightly rubbed with sandpaper, the undyed inner layer was not exposed and did not look whitish, and thus it was excellent. Moreover, the hook-and-loop-coexisting type hook-and-loop fastener after the dyeing was excellent in the pull-out resistance of the hook-shaped engaging elements as well as the value before the dyeing. Then, the yarns for hook-shaped engaging elements and the warp yarns were extracted from the dyed hook-and-loop-coexisting type hook-and-loop fastener and subjected to GPC measurement, and as a result, the molecular weight distribution and the weight-average molecular weight were substantially the same values as those in Example 1.

Example 6

A hook type hook-and-loop fastener was produced in the same manner as in Example 1 except that the following yarns were used as the warp yarn and the yarn for hook engaging elements in Example 1.

[Warp Yarn]

- Multifilament yarn made of PET (ECOPET Material Recycle 100%: made of recovered PET, manufactured by Teijin Limited)
- Total dtex and number of filaments: 30 in 167 dtex
- Dry heat shrinkage at 200° C.: 24.2%
- Melting peak temperature by DSC measurement: 257.0° C.
- Molecular weight distribution (Mw/Mn) by GPC measurement: 4.3
- Weight-average molecular weight (Mw) by GPC measurement: 19700

[Monofilament Yarn for Hook-Shaped Engaging Elements]

- Monofilament yarn made of PET (ECORON Material Recycle 100%: made of recovered PET, manufactured by Takada Kasei Kogyo K.K.)
- Diameter (before heat shrinkage): 0.19 mm
- Dry heat shrinkage at 200° C.: 27.1%
- Melting peak temperature by DSC measurement: 257.2° C.
- Molecular weight distribution (Mw/Mn) by GPC measurement: 4.0
- Weight-average molecular weight (Mw) by GPC measurement: 18000

The shrinkage rate in the weft direction of the woven base fabric at the time of producing the hook type hook-and-loop fastener (at the time of heat treatment) was 11%, the density of the hook-shaped engaging elements of the obtained hook type hook-and-loop fastener was 49 pieces/cm$^2$, and the height of the hook-shaped engaging elements from the woven base fabric surface was 1.3 mm. In the hook type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb)/(Ts) was 0.88.

When the warp yarns and the yarns for engaging elements constituting the hook type hook-and-loop fastener were taken out from the hook type hook-and-loop fastener and the melting peak temperature was measured by DSC measurement, the melting peak temperature of the warp yarns was 257.1° C., and the melting peak temperature of the yarns for engaging elements was 257.4° C. Then, as a result of measuring the pull-out force of the hook-shaped engaging elements of the hook type hook-and-loop fastener, an excellent value of 10.34 N was obtained.

Next, when the engaging force of this hook type hook-and-loop fastener was measured, the initial engaging force was 15.0 N/cm$^2$ in shear strength and 1.34 N/cm in peel strength, and the engaging force after 1000 times of engagement and peeling was 14.4 N/cm$^2$ in shear strength and 1.30 N/cm in peel strength, and even after 1000 times of engagement and peeling were repeated, hook-shaped engaging elements pulled out from the surfaces of the hook type hook-and-loop fastener were not observed, and further, waving in the vertical direction was not observed, and thus it was found that the hook type hook-and-loop fastener was extremely excellent. Further, when the surfaces of the obtained hook type hook-and-loop fastener were observed, waving in the vertical direction of the hook-and-loop fastener was not observed in the heat treatment step, and as a result, cutting of one leg of the hook-shaped engaging elements could be performed without any problem.

When this hook type hook-and-loop fastener was dyed under the above-described dyeing conditions, a hook type hook-and-loop fastener dyed in a deep color with a degree of exhaustion of 96.0% was obtained, and it was found that the hook type hook-and-loop fastener had excellent dyeability. Further, even when the surface of the hook-shaped engaging element after dyeing was lightly rubbed with sandpaper, the undyed inner layer was not exposed, and it was found that the hook-shaped engaging element was excellent also in this respect. Moreover, the hook type hook-and-loop fastener did not shrink unevenly in the dyeing step to cause waving in the vertical direction. Further, the hook type hook-and-loop fastener after the dyeing was excellent in the pull-out resistance of the hook-shaped engaging elements as well as in the value before the dyeing.

A part of the hook-shaped engaging elements and a part of the warp yarns were extracted from the dyed hook-and-loop fastener and subjected to GPC analysis, and as a result, the molecular weight distributions were 4.1 for the hook-shaped engaging elements and 4.3 for the warp yarns.

Example 7

A hook type hook-and-loop fastener was produced in the same manner as in Example 1 except that the following yarns were used as the warp yarn and the yarn for hook engaging elements in Example 1.

[Warp Yarn]

- Multifilament yarn made of PET (ECOPET Material Recycle 100%: made of recovered PET, manufactured by Teijin Limited)

Total dtex and number of filaments: 30 in 167 dtex
Dry heat shrinkage at 200° C.: 21.1%
Melting peak temperature by DSC measurement: 254.0° C.
Molecular weight distribution (Mw/Mn) by GPC measurement: 4.3
Weight-average molecular weight (Mw) by GPC measurement: 19900

[Monofilament Yarn for Hook-Shaped Engaging Elements]
Monofilament yarn made of PET (ECORON Material Recycle 100%: made of recovered PET, manufactured by Takada Kasei Kogyo K.K.)
Diameter (before heat shrinkage): 0.19 mm
Dry heat shrinkage at 200° C.: 23.6%
Melting peak temperature by DSC measurement: 254.3° C.
Molecular weight distribution (Mw/Mn) by GPC measurement: 4.0
Weight-average molecular weight (Mw) by GPC measurement: 18000

The shrinkage rate in the weft direction of the woven base fabric at the time of producing the hook type hook-and-loop fastener (at the time of heat treatment) was 11%, the density of the hook-shaped engaging elements of the obtained hook type hook-and-loop fastener was 43 pieces/cm$^2$, and the height of the hook-shaped engaging elements from the woven base fabric surface was 1.6 mm.

In addition, in the hook type hook-and-loop fastener, when the warp yarn thickness (Tb) in the woven base fabric thickness direction at the position where the warp yarn sinks most on the back surface side and the warp yarn thickness (Ts) in the woven base fabric thickness direction at the position where the warp yarn floats most on the front surface side were measured, (Tb)/(Ts) was 0.89. Then, when the warp yarns and the yarns for engaging elements constituting the hook type hook-and-loop fastener were taken out from the hook type hook-and-loop fastener and the melting peak temperature was measured by DSC measurement, the melting peak temperature of the warp yarns was 254.2° C., and the melting peak temperature of the yarns for engaging elements was 254.6° C.

Then, as a result of measuring the pull-out force of the hook-shaped engaging elements of the hook type hook-and-loop fastener, it was found to be 8.73 N and to have high pull-out resistance. When the surfaces of the obtained hook type hook-and-loop fastener were observed, waving in the vertical direction of the hook type hook-and-loop fastener was not observed in the heat treatment step, and as a result, cutting of one leg of the hook-shaped engaging elements could be performed without any problem.

Then, when the engaging force of this hook type hook-and-loop fastener was measured, the initial engaging force was 14.6 N/cm$^2$ in shear strength and 1.29 N/cm in peel strength, and the engaging force after 1000 times of engagement and peeling was 14.2 N/cm$^2$ in shear strength and 1.22 N/cm in peel strength, and after 1000 times of engagement and peeling were repeated, it was found that the hook-shaped engaging elements pulled out from the surfaces of the hook type hook-and-loop fastener were very slightly observed, but it was excellent as the hook type hook-and-loop fastener.

When this hook type hook-and-loop fastener was dyed under the above-described dyeing conditions, a hook type hook-and-loop fastener dyed in a deep color with a degree of exhaustion of 95.2% was obtained, and it was found that the hook type hook-and-loop fastener had excellent dyeability. Further, even when the surface of the hook-shaped engaging element after dyeing was lightly rubbed with sandpaper, the undyed inner layer was hardly exposed, and it was found that the hook-shaped engaging element was excellent also in this respect. Moreover, the hook type hook-and-loop fastener did not shrink unevenly in the dyeing step to cause waving in the vertical direction. The pull-out resistance of the hook-shaped engaging elements of the hook type hook-and-loop fastener after the dyeing was also the same as the value before the dyeing, and was also excellent in this respect. A part of the hook-shaped engaging elements and a part of the warp yarns were extracted from the dyed hook type hook-and-loop fastener and subjected to GPC analysis, and as a result, the molecular weight distributions (Mw/Mn) were 4.0 for the hook-shaped engaging elements and 4.3 for the warp yarns.

Comparative Example 5

A hook-and-loop-coexisting type hook-and-loop fastener was produced in the same manner as in Example 3 except that the following yarns were used as the warp yarn and the yarn for hook-shaped engaging elements in Example 3.

[Warp Yarn]
Multifilament yarn made of PET (conventional high-shrinkage yarn made of fiber grade PET manufactured by Kuraray Co., Ltd.)
Total dtex and number of filaments: 30 in 167 dtex
Dry heat shrinkage at 200° C.: 30.4%
Melting peak temperature by DSC measurement: 261.8° C.
Molecular weight distribution (Mw/Mn) by GPC measurement: 4.7
Weight-average molecular weight (Mw) by GPC measurement: 18400

[Monofilament Yarn for Hook-Shaped Engaging Elements]
Monofilament yarn made of PET (ECORON Material Recycle 100%: made of recovered PET, manufactured by Takada Kasei Kogyo K.K.)
Diameter (before heat shrinkage): 0.19 mm
Dry heat shrinkage at 200° C.: 37.7%
Melting peak temperature by DSC measurement: 262.1° C.
Molecular weight distribution (Mw/Mn) by GPC measurement: 5.0
Weight-average molecular weight (Mw) by GPC measurement: 20000

As a result of measuring the pull-out force of the hook-shaped engaging elements of this hook-and-loop-coexisting type hook-and-loop fastener, it was found that the pull-out force was 6.15 N, which was considerably inferior to any of the above-mentioned Examples. As a result of a test for dyeing the hook-and-loop-coexisting type hook-and-loop fastener, the degree of exhaustion was 94.8%, and it was found that the hook-and-loop-coexisting type hook-and-loop fastener was not sufficiently dyed. In addition, in the dyeing step, the hook-and-loop-coexisting type hook-and-loop fastener shrinks non-uniformly to cause slight waving in the vertical direction. From this, it can be seen that the pull-out resistance and the dyeability of the engaging element are not improved by simply using a material having a high dry heat shrinkage as the yarn for hook-shaped engaging elements or the warp yarn.

In addition, when the warp yarns and the yarns for engaging elements constituting the hook-and-loop-coexisting type hook-and-loop fastener were taken out from the hook-and-loop-coexisting type hook-and-loop fastener and the melting peak temperature was measured by DSC measurement, the melting peak temperature of the warp yarns was 262.0° C., and the melting peak temperature of the yarns for engaging elements was 262.4° C. Further, the pull-out resistance of the hook-shaped engaging elements of the hook-and-loop-coexisting type hook-and-loop fastener after the dyeing was the same as the value before the dyeing and was inferior. A part of the hook-shaped engaging elements and a part of the warp yarns were extracted from the dyed hook-and-loop-coexisting type hook-and-loop fastener and subjected to GPC analysis, and as a result, the molecular weight distributions were 4.9 for the hook-shaped engaging elements and 4.8 for the warp yarns.

Comparative Example 6

A dyed hook type hook-and-loop fastener was produced in the same manner as in Example 1, except that the multifilament yarn used as the warp yarn in Example 1 was changed to the following yarn.

[Warp Yarn]

- Multifilament yarn made of PET (PET copolymerized with 4 mol % of isophthalic acid)
- Total dtex and number of filaments: 30 in 167 dtex
- Dry heat shrinkage at 200° C.: 17.8%
- Melting peak temperature by DSC measurement: 249.1° C.
- Molecular weight distribution (Mw/Mn) by GPC measurement: 4.7
- Weight-average molecular weight (Mw) by GPC measurement: 20000

The density of the hook-shaped engaging elements of the obtained woven fabric for the hook type hook-and-loop fastener was 41 pieces/cm$^2$, and the height of the hook-shaped engaging elements from the woven base fabric surface was 1.3 mm. Then, when the warp yarns constituting the hook type hook-and-loop fastener were taken out from the hook type hook-and-loop fastener and the melting peak temperature was measured by DSC measurement, and it was 249.4° C.

Since the melting peak temperature of the warp yarn was low, the texture of the hook type hook-and-loop fastener was hard, the hook-shaped engaging elements were easy to fall, and the forces of the hook-shaped engaging elements to hold the hook shape were weak, and as a result, when the engaging force of the hook type hook-and-loop fastener was measured, the initial engaging force was 13.2 N/cm$^2$ in shear strength and 0.80 N/cm in peel strength, and it was found that the initial engaging force was inferior to that of Example 1. A part of the warp yarns was extracted from the dyed hook type hook-and-loop fastener and subjected to GPC analysis, and as a result, the molecular weight distribution was 4.7. From the above results, it is understood that when a yarn having a melting point lower than the range specified in the present invention is used as the warp yarn, a product having a new problem is obtained.

Comparative Example 7

A woven hook type hook-and-loop fastener tape was produced in the same manner as in Comparative Example 6 except that the temperature at the time of heat-treating the hook type hook-and-loop fastener tape woven in Comparative Example 6 was changed to 190° C. in order to maintain the texture of the hook type hook-and-loop fastener of Comparative Example 6.

When the warp yarns constituting the hook type hook-and-loop fastener were taken out from the hook type hook-and-loop fastener and the melting peak temperature was measured by DSC measurement, and it was 249.6° C. which was substantially the same as that of Comparative Example 6. It was found that the state of the hook-shaped engaging elements of the hook type hook-and-loop fastener had the same problem as that of the hook type hook-and-loop fastener of Comparative Example 6, and the engaging force was a value almost equivalent to that of the hook type hook-and-loop fastener of Comparative Example 6 and was inferior, and the engaging force could not be improved only by adjusting the heat treatment temperature.

TABLE 1

| | | | | Ex. 1 | Comp. Ex. 1 | Comp. Ex. 2 | Ex. 2 | Ex. 3 | Comp. Ex. 3 | Ex. 4 | Comp. Ex. 4 | Ex. 5 | Ex. 6 | Ex. 7 | Comp. Ex. 5 | Comp. Ex. 6 | Comp. Ex. 7 |
|---|---|---|---|---|---|---|---|---|---|---|---|---|---|---|---|---|---|
| | Warp yarn | Melting peak temperature | [° C.] | 256.0 | 261.4 | 261.4 | 256.0 | 256.0 | 261.4 | 256.0 | 261.4 | 256.0 | 257.0 | 254.0 | 261.8 | 249.1 | 249.1 |
| | | Molecular weight distribution (Mw/Mn) | — | 4.2 | 4.6 | 4.6 | 4.2 | 4.2 | 4.6 | 4.2 | 4.6 | 4.2 | 4.3 | 4.3 | 4.7 | 4.7 | 4.7 |
| | | Weight-average molecular weight (Mw) | — | 19900 | 18200 | 18200 | 19900 | 19900 | 18200 | 19900 | 18200 | 19900 | 19700 | 19900 | 18400 | 20000 | 20000 |
| | | Dry heat shrinkage | — | 22.1 | 18.8 | 18.8 | 22.1 | 22.1 | 18.8 | 22.1 | 18.8 | 22.1 | 24.2 | 21.1 | 30.4 | 17.8 | 17.8 |
| | Weft yarn | Dry heat shrinkage | [%] | 17.1 | 17.1 | 17.1 | 17.1 | 17.1 | 17.1 | 17.1 | 17.1 | 16.2 | 17.1 | 17.1 | 17.1 | 17.1 | 17.1 |
| | | Melting peak temperature | [° C.] | 256.5 | 260.7 | 260.7 | 260.7 | 256.5 | 260.7 | 260.7 | 256.5 | 256.5 | 257.2 | 254.3 | 262.1 | 256.5 | 256.5 |
| Monofilament yarn for hook-shaped engaging elements | | Molecular weight distribution (Mw/Mn) | — | 3.9 | 5.0 | 5.0 | 5.0 | 3.9 | 5.0 | 5.0 | 3.9 | 3.9 | 4.0 | 4.0 | 5.0 | 3.9 | 3.9 |
| | | Weight-average molecular weight (Mw) | — | 18000 | 21000 | 21000 | 21000 | 18000 | 21000 | 21000 | 18000 | 18000 | 18000 | 18000 | 20000 | 18000 | 18000 |
| Monofilament yarn for loop-shaped engaging elements | | Dry heat shrinkage*4 | [%] | 24.2 | 21.4 | 21.4 | 21.4 | 24.2 | 21.4 | 21.4 | 24.2 | 24.2 | 27.1 | 23.6 | 37.7 | 24.2 | 24.2 |
| | | Dry heat shrinkage*4 | [%] | — | — | — | — | 16.6 | 16.6 | 16.6 | 16.6 | 16.6 | — | — | 16.6 | — | — |
| | Warp yarn | Melting peak temperature | [° C.] | 257.3 | 261.5 | 261.8 | 257.3 | 255.2 | 261.6 | 255.2 | 261.4 | 255.6 | 257.1 | 254.2 | 262.0 | 249.4 | 249.6 |
| | | Molecular weight distribution (Mw/Mn) | — | 4.2 | 4.7 | — | 4.2 | 4.2 | 4.7 | 4.2 | 4.7 | 4.2 | 4.3 | 4.3 | 4.8 | 4.7 | — |
| | | Weight-average molecular weight (Mw) | — | 19000 | 17800 | — | — | 19000 | 17800 | 19000 | 17800 | 19000 | — | — | — | — | — |
| | | Melting peak temperature | — | 252.4 | 258.3 | 258.1 | 258.7 | 253.8 | 257.9 | 259.0 | 253.4 | 254.0 | 257.4 | 254.6 | 262.4 | — | — |
| | | Molecular weight distribution (Mw/Mn) | — | 4.0 | 4.9 | — | 4.9 | 4.0 | 4.9 | 4.0 | 4.0 | 4.0 | 4.1 | 4.0 | 4.9 | — | — |
| | Hook-shaped engaging element | Weight-average molecular weight (Mw) | — | 17400 | 20600 | — | | 17400 | 20600 | 17400 | 17400 | 17400 | — | — | — | — | — |
| | | Density | [pieces/cm$^2$] | 45 | 38 | 38 | 43 | 32 | 27 | 32 | — | 32 | 49 | 43 | — | 41 | — |
| Woven hook-and-loop fastener | Loop-shaped engaging element | Hight from woven base fabric surface | [mm] | 1.5 | 1.3 | 1.3 | 1.5 | 1.6 | 1.8 | 1.7 | — | 1.6 | 1.3 | 1.6 | — | 1.3 | — |
| | | Density | [pieces/cm$^2$] | — | — | — | — | 32 | 27 | 32 | — | 32 | — | — | — | — | — |
| | | Hight from woven base fabric surface | [mm] | — | — | — | — | 2.1 | 2.1 | 2.1 | — | 2.1 | — | — | — | — | — |
| (Tb)/(Ts) | | | — | 0.89 | — | 0.97 | 0.90 | 0.87 | — | 0.90 | — | 0.89 | 0.88 | 0.89 | — | — | — |
| Pull-out force of hook-shaped engaging element | | | [N] | 10.01 | 7.26 | 6.45 | 9.43 | 7.61 | 4.45 | 7.47 | 4.85 | 7.22 | 10.34 | 8.73 | 6.15 | — | — |
| | Engaging | Shear strength | [N/cm$^2$] | 14.9 | — | — | 14.2 | 10.3 | — | 10.1 | — | 10.8 | 15.0 | 14.6 | — | 13.2 | — |

TABLE 1-continued

| | | | Ex. 1 | Comp. Ex. 1 | Comp. Ex. 2 | Ex. 2 | Ex. 3 | Comp. Ex. 3 | Ex. 4 | Comp. Ex. 4 | Ex. 5 | Ex. 6 | Ex. 7 | Comp. Ex. 5 | Comp. Ex. 6 | Comp. Ex. 7 |
|---|---|---|---|---|---|---|---|---|---|---|---|---|---|---|---|---|
| force (initial) | Peel strength | [N/cm] | 1.32 | — | — | 1.26 | 1.42 | — | 1.32 | — | 1.49 | 1.34 | 1.29 | — | 0.80 | — |
| Engaging force (after 1000 times | Shear strength | [N/cm$^2$] | 14.3 | — | — | 13.7 | 9.0 | — | 8.7 | — | 9.2 | 14.4 | 14.2 | — | — | — |
| engagement and peeling) | Peel strength | [N/cm] | 1.28 | — | — | 1.21 | 1.29 | — | 1.27 | — | 1.35 | 1.30 | 1.22 | — | — | — |
| Degree of exhaustion | | [%] | 95.6 | — | 91.7 | 95.2 | 95.8 | 92.4 | 95.4 | 93.4 | 96.2 | 96.0 | 95.2 | 94.8 | — | — |

REFERENCE SIGNS LIST

1: Woven base fabric
2: Loop for hook-shaped engaging elements
3: Heat treatment oven
4: Fixed surface or roll surface
5: Warp yarn
6: Weft yarn
7: Hook-shaped engaging element
Tb: Warp yarn thickness in woven base fabric thickness direction at the position where warp yarn sinks most on the back surface side
Ts: Warp yarn thickness in woven base fabric thickness direction at the position where warp yarn floats most on the front surface side

The invention claimed is:

1. A polyethylene terephthalate-based woven hook-and-loop fastener, which comprises, as a woven base fabric, a fabric having a multifilament yarn made of polyethylene terephthalate as a warp yarn and a polyester-based heat-fusible multifilament yarn as a weft yarn, wherein a monofilament yarn made of polyethylene terephthalate is woven in parallel with the warp yarn into the woven base fabric, a hook-shaped engaging element formed from the monofilament yarn and rising from the surface of the woven base fabric exists on the surface of the woven base fabric, and a root of the hook-shaped engaging element is fixed to the woven base fabric by a melt-solidified product of a heat-fusible component of the polyester-based heat-fusible multifilament yarn, wherein a melting peak temperature of the warp yarn by DSC measurement is in a range of 251.0 to 257.5° C., and wherein a molecular weight distribution (Mw/Mn) of the polyethylene terephthalate constituting the warp yarn is in a range of 4.0 to 4.5.

2. The polyethylene terephthalate-based woven hook-and-loop fastener according to claim 1, wherein a melting peak temperature of the monofilament yarn by DSC measurement is in a range of 251.0 to 257.5° C., and a molecular weight distribution (Mw/Mn) of the polyethylene terephthalate constituting the monofilament yarn is in a range of 3.8 to 4.7.

3. The polyethylene terephthalate-based woven hook-and-loop fastener according to claim 1, wherein the woven base fabric satisfies that a thickness of the warp yarn (Tb) in a woven base fabric thickness direction at a position where the warp yarn, which floats and sinks above and below the weft yarn with the weft yarn interposed therebetween, sinks most on a back surface side is 0.94 times or less a thickness of the warp yarn (Ts) in the woven base fabric thickness direction at a position where the warp yarn floats most on a front surface side.

4. The polyethylene terephthalate-based woven hook-and-loop fastener according to claim 1, wherein a degree of exhaustion is in a range of 95 to 97%.

5. The polyethylene terephthalate-based woven hook-and-loop fastener according to claim 1, wherein the warp yarn is a yarn made of polyethylene terephthalate recovered from a polyethylene terephthalate bottle.

6. The polyethylene terephthalate-based woven hook-and-loop fastener according to claim 1, wherein on the surface of the woven base fabric, a loop-shaped engaging element formed from a polyester-based multifilament yarn and rising from the surface of the woven base fabric coexists on the same surface as the hook-shaped engaging element, a root of the loop-shaped engaging element is fixed to the woven base fabric by a melt-solidified product of a heat-fusible component of the heat-fusible multifilament yarn, and the multifilament yarn for loop-shaped engaging elements is a yarn made of polybutylene terephthalate.

7. A dyed polyethylene terephthalate-based woven hook-and-loop fastener obtained by dyeing the polyethylene terephthalate-based woven hook-and-loop fastener according to claim 1 with a disperse dye.

8. A method for producing the polyethylene terephthalate-based woven hook-and-loop fastener according to claim 1, in which a multifilament yarn made of polyethylene terephthalate recovered from a polyethylene terephthalate bottle is used as the warp yarn, a polyester-based heat-fusible multifilament yarn is used as the weft yarn, and a monofilament yarn made of polyethylene terephthalate is woven as a yarn for hook-shaped engaging elements in parallel with the warp yarn, wherein hook-shaped engaging elements formed from the yarn for hook-shaped engaging elements are present on a surface of the polyethylene terephthalate-based woven hook-and-loop fastener, and the method comprising performing the following Step A, Step B, and Step D in this order:

[Step A] a step of, when weaving a woven base fabric having a loop from the warp yarn, the weft yarn, and the yarn for hook-shaped engaging elements, weaving the yarn for hook-shaped engaging elements in parallel with the warp yarn, and at the same time, forming a loop for hook-shaped engaging element by causing the yarn for hook-shaped engaging elements to straddle the warp yarn and to rise in a loop shape from the surface of the woven base fabric at a straddling portion, and weaving the woven base fabric having a loop;

[Step B] a step of guiding the woven base fabric having a loop to a heating region, heating the woven base fabric to a temperature equal to or higher than a temperature at which a heat-fusible component of the heat-fusible multifilament yarn is melted, and fixing a rising portion of the loop for hook-shaped engaging element to the woven base fabric having a loop by a melt from the heat-fusible multifilament yarn; and

[Step D] a step of cutting one leg of the loop for hook-shaped engaging element to form the hook-shaped engaging element.

9. The method for producing a polyethylene terephthalate-based woven hook-and-loop fastener according to claim 8, wherein the yarn for hook-shaped engaging elements is a yarn made of polyethylene terephthalate recovered from a polyethylene terephthalate bottle.

10. The method for producing a polyethylene terephthalate-based woven hook-and-loop fastener according to claim 8, wherein a melting peak temperature by DSC measurement of the yarn for hook-shaped engaging elements to be subjected to the Step A is in a range of 251.0 to 257.5° C.

11. The method for producing a polyethylene terephthalate-based woven hook-and-loop fastener according to claim 8, comprising performing the following Step C between the Step B and the Step D:

[Step C] a step of taking out the woven base fabric having a loop from the heating region of the Step B and pressing a back surface of the woven base fabric having a loop against a fixed surface or a roll surface in a state where the heat-fusible component of the heat-fusible multifilament yarn is melted.

12. The method for producing a polyethylene terephthalate woven hook-and-loop fastener according to claim 11, wherein the Step C is performed by a method in which the woven base fabric having a loop for hook-shaped engaging element is caused to travel while sliding on the fixed surface while pressing the back surface of the woven base fabric having a loop against the fixed surface, and the traveling direction of the woven base fabric having a loop is changed on the fixed surface.

13. The method for producing a polyethylene terephthalate woven hook-and-loop fastener according to claim 11, wherein the Step C is performed at a temperature lower than the temperature of the Step B by utilizing a remaining heat of the Step B without cooling the woven base fabric having a loop for hook-shaped engaging element taken out from the Step B.

14. The method for producing a polyethylene terephthalate-based woven hook-and-loop fastener according to claim 9, wherein the warp yarn and the yarn for hook-shaped engaging elements to be subjected to the Step A satisfy the following conditions (1) to (3):

(1) the warp yarn has a dry heat shrinkage at 200° C. in a range of 20 to 25%;

(2) the yarn for hook-shaped engaging elements has a dry heat shrinkage at 200° C. in a range of 22.5 to 27.5%; and (3) the yarn for hook-shaped engaging elements has a dry heat shrinkage at 200° C. higher than that of the warp yarn at 200° C. by 1 to 5%.

15. The method for producing a polyethylene terephthalate-based woven hook-and-loop fastener according to claim 8, wherein in the Step A, a multifilament yarn for loop-shaped engaging elements made of polybutylene terephthalate is further woven into the base fabric in parallel with the warp yarn, the multifilament yarn for loop-shaped engaging elements is raised in a loop shape from the surface of the woven base fabric, and the loop for loop-shaped engaging elements is allowed to coexist with the loop for hook-shaped engaging element on the same surface.

16. The method for producing a polyethylene terephthalate woven hook-and-loop fastener according to claim 15, wherein in the Step B, the rising portion of the loop for loop-shaped engaging elements is fixed to the woven base fabric having a loop.

17. A method for producing a dyed polyethylene terephthalate-based woven hook-and-loop fastener, comprising dyeing the polyethylene terephthalate-based woven hook-and-loop fastener according to claim 8 with a disperse dye.

* * * * *